US008297939B2

(12) United States Patent
Oguma et al.

(10) Patent No.: US 8,297,939 B2
(45) Date of Patent: Oct. 30, 2012

(54) METHOD OF PUMPING AGGLOMERATIVE LIQUID AND METHOD OF PRODUCING RECORDING MEDIUM

(75) Inventors: Kazuaki Oguma, Kanagawa (JP); Ryuji Abe, Tokyo (JP)

(73) Assignee: Fujifilm Corporation, Tokyo (JP)

( * ) Notice: Subject to any disclaimer, the term of this patent is extended or adjusted under 35 U.S.C. 154(b) by 650 days.

(21) Appl. No.: 12/458,826

(22) Filed: Jul. 23, 2009

(65) Prior Publication Data

US 2010/0021326 A1 Jan. 28, 2010

(30) Foreign Application Priority Data

Jul. 24, 2008 (JP) ..... P2008-191495

(51) Int. Cl.
*F04B 43/12* (2006.01)
*F04B 49/06* (2006.01)
*F01B 19/00* (2006.01)

(52) U.S. Cl. ..... 417/53; 92/98 R; 417/383

(58) Field of Classification Search ..... 417/53, 417/379, 383, 389, 390, 395, 413.1, 472; 92/96, 98 R See application file for complete search history.

(56) References Cited

U.S. PATENT DOCUMENTS 2,711,134 A * 6/1955 Hughes ..... 92/99
2,764,097 A * 9/1956 Browne ..... 92/98 R
3,416,461 A * 12/1968 McFarland ..... 92/98 R
3,551,076 A * 12/1970 Wilson ..... 92/98 R
3,902,826 A * 9/1975 Nagel et al. ..... 417/386
4,086,036 A * 4/1978 Hagen et al. ..... 417/413.1
4,474,540 A * 10/1984 Bonastia et al. ..... 417/388
5,554,014 A * 9/1996 Becker ..... 417/413.1
7,401,543 B2 * 7/2008 Curtis ..... 92/98 R

FOREIGN PATENT DOCUMENTS

JP 52-65902 5/1977
JP 4-320898 A 11/1992
JP 2001-115967 A 4/2001
JP 2002-370065 A 12/2002
JP 2005-001299 A 1/2005
JP 2005-220834 A 8/2005
JP 2007-278177 A 10/2007

OTHER PUBLICATIONS

Japanese Office Action dated Sep. 4, 2012 with a partial English translation thereof.

* cited by examiner

*Primary Examiner* — Peter J Bertheaud
(74) *Attorney, Agent, or Firm* — McGinn IP Law Group, PLLC

(57) ABSTRACT

A method of pumping an agglomerative liquid includes providing a diaphragm pump defined herein and pumping the agglomerative liquid using the diaphragm pump, the diaphragm has an annular thickened portion in the peripheral portion thereof as defined herein, the pump head has at least one channel communicating the inner peripheral edge of the clamping surface and the pump chamber, the diaphragm is reciprocally movable in opposite directions perpendicular to the diaphragm plane to increase and decrease the volume of the pump chamber so as to pump the liquid, the thickened portion of the diaphragm, the holding member, and the pump head are configured to satisfy the relation A<B as defined herein, and the reciprocal movement of the diaphragm is from the flat state toward the pump chamber side and from the flat state toward the side opposite to the pump chamber side.

12 Claims, 9 Drawing Sheets

METHOD OF PUMPING AGGLOMERATIVE LIQUID AND METHOD OF PRODUCING RECORDING MEDIUM

CROSS-REFERENCE TO RELATED APPLICATIONS

This application claims the benefit of Japanese Patent Application JP 2008-191495, filed Jul. 24, 2008, the entire content of which is hereby incorporated by reference, the same as if set forth at length.

FIELD OF THE INVENTION

This invention relates to a method of pumping an agglomerative liquid using a diaphragm pump and a method of producing a recording medium using the pumping method.

BACKGROUND OF THE INVENTION

A diaphragm pump typically includes a diaphragm, a pump frame having a holding member in which the diaphragm is held, and a pump head clamping the periphery of the diaphragm onto the pump frame. The diaphragm and the pump head define a pump chamber, the volume of which increases and decreases by the reciprocating action of the diaphragm. A non-return check valve is provided in the intake side and the discharge side of the pump chamber so that a liquid is delivered in one direction.

Because a diaphragm pump has its pump chamber closed and includes no sliding part in the portions in contact with a liquid being handled, there is no fear of debris (that may be produced in a pump having a sliding part, such as a piston pump or a centrifugal pump) or oil getting mixed in the liquid being pumped. Therefore, it is used in handling low or high viscosity liquids, suspensions, corrosive liquid chemicals, and the like in a wide variety of fields, typically in manufacturing products that must be free of foreign matter, such as semiconductors, recording media, and foods.

Although a diaphragm pump permits no foreign matter to enter, it often meets the problem of agglomerates forming on the diaphragm when it handles a liquid containing fine particles that agglomerate easily due to shear stress or collision of the particles, such as a polymer latex.

If agglomerates form on the diaphragm, they can clog the downstream pumping system, such as a check valve. In that case, the diaphragm pump cannot be operated continuously but batchwise such that operation, suspension, and cleaning make one cycle. This impairs the operating efficiency. In the manufacture of products that should be protected from contamination with foreign matter as described, the agglomerates forming on the diaphragm can get mixed in the product and damage the qualities of the product. In the case of handling a coating composition for image formation, for example, the agglomerates will affect coating properties of the coating composition in, e.g., slide coating. Even small agglomerates not so large as to affect slide coating can cause an image defect.

A diaphragm pump for pumping a liquid liable to agglomeration under shear force applied, such as a latex, has been proposed with a structure capable of preventing the liquid from forming an agglomerate as disclosed in JP-U-52-065902.

According to the structure of JP-U-52-065902, a driving rod is attached to a diaphragm to control the reciprocal motion of the diaphragm. The diaphragm is displaced toward the pump head only until it becomes flat so that the range of movement of the diaphragm is only outward of the pump chamber. As a result, the stroke length of the diaphragm is short to reduce the flow rate and to minimize the shear force imposed on the liquid. The diaphragm used in JP-U-52-065902 has its peripheral edge thickened in order to overcome the problem with conventional diaphragms that a liquid sandwiched between the peripheral portion of the diaphragm and the pump head is subjected to excessive shear force to cause particle agglomeration. The increased thickness along the edge of the diaphragm provides an increased gap between the pump head and the peripheral portion of the diaphragm continuous with the thickened edge. As a result, a liquid is prevented from forming agglomerates due to shear force exerted in the gap between the edge of the diaphragm and the pump head.

SUMMARY OF THE INVENTION

In the diaphragm of JP-U-52-065902, the displacement of the diaphragm toward the pump head is only until the diaphragm becomes flat, and the reciprocal movement of the diaphragm is confined within a region outward of the pump chamber. This structure is likely to cause a liquid to stagnate in the gap between the peripheral portion of the diaphragm and the pump head, which can result in agglomeration. Moreover, the limited range of movement of the diaphragm means a reduced volume delivered per stroke, which can result in reduction of pumping efficiency.

An object of the present invention is to provide a method of pumping an agglomerative liquid, such as a suspension having fine particles dispersed therein, without causing the liquid to form agglomerates. Another object of the invention is to provide a method of producing a recording medium using the pumping method.

The object of the invention is accomplished by the provision of (1) a method of pumping an agglomerative liquid using a diaphragm pump. The diaphragm pump includes a diaphragm having a peripheral portion and a movable portion, a pump frame having a diaphragm holding member, and a pump head having a clamping surface. The diaphragm is supported on one side of its peripheral portion by the pump frame and clamped on the other side of its peripheral portion by the clamping surface of the pump head. The diaphragm and the pump head define a pump chamber. The diaphragm has an annular thickened portion in its peripheral portion, the thickened portion being substantially thicker than the movable portion and projecting toward the pump head. The pump head has at least one channel communicating the inner peripheral edge of the clamping surface and the pump chamber. The diaphragm is reciprocally movable in opposite directions perpendicular to the diaphragm plane to increase and decrease the volume of the pump chamber thereby to pump the liquid. The thickened portion of the diaphragm, the holding member, and the pump head are configured to satisfy relation $A<B$, wherein A is the maximum distance from the inner periphery of the holding member to the inner peripheral edge of the thickened portion measured on the surface of the thickened portion clamped by the pump head, and B is the minimum distance between the inner periphery of the holding member and the inner peripheral edge of the clamping surface of the pump head measured on the clamping surface in other than the region having the channel. The reciprocal movement of the diaphragm is from the flat state toward the pump chamber side and from the flat state toward the side opposite to the pump chamber side (the working fluid chamber side).

The method of pumping an agglomerative liquid according to the invention embraces the following preferred embodiments (2) to (4).

(2) The annular thickened portion of the diaphragm, the holding member, and the pump head are configured to satisfy relation C<A, wherein C is the maximum distance from the inner to the outer peripheral edges of the thickened portion of the diaphragm measured on the surface of the thickened portion clamped by the clamping surface of the pump head.

(3) The agglomerative liquid is an image-forming coating composition containing a polymer latex.

(4) At least a surface portion of the diaphragm is made of a fluororesin.

The object of the invention is also accomplished by the provision of the following methods (5) to (8) for producing a recording medium.

(5) A method of producing an inkjet recording medium. The method comprises pumping a coating composition by the pumping method according to the preferred embodiment (3) or (4) in which the image-forming coating composition is for forming an ink receiving layer of an inkjet recording medium.

(6) A method of producing an electrophotographic recording medium. The method comprises pumping a coating composition by the pumping method according to the preferred embodiment (3) or (4) in which the image-forming coating composition is for forming a toner receiving layer of an electrophotographic recording medium.

(7) A method of producing a thermal transfer recording medium. The method comprises pumping a coating composition by the pumping method according to the preferred embodiments (3) or (4) in which the image-forming coating composition is for forming an image receiving layer of a thermal transfer recording medium.

(8) A method of producing a heat developable recording medium. The method comprises pumping a coating composition by the pumping method according to the preferred embodiments (3) or (4) in which the image forming coating composition is for forming a photosensitive layer of a heat developable recording medium.

With the relation A<B satisfied (wherein A is the maximum distance from the inner periphery of the holding member of the pump frame to the inner peripheral edge of the thickened portion measured on the surface of the thickened portion clamped by the pump head; and B is the minimum distance from the inner periphery of the holding member to the inner peripheral edge of the clamping surface of the pump head measured on the clamping surface in other than the region having the channel communicating the inner peripheral edge of the clamping surface to the pump chamber), the thickened portion of the diaphragm is completely sandwiched between the holding member of the pump frame and the clamping surface of the pump head so that the inner peripheral end portion of the thickened portion may not stick into the pump chamber beyond the inner peripheral edge of the clamping surface of the pump head. As a result, no gap forms between the thickened portion of the diaphragm and the pump head, in which an agglomerative liquid might stagnate to cause particles to agglomerate. The volume of a gap between the diaphragm and the pump head contracts with the deflection of the diaphragm toward the pump chamber side, and the volume of the gap expands with the deflection of the diaphragm toward the working fluid chamber side, whereby the liquid in the gap circulates and is thus prevented from stagnating there. As a result, even an agglomerative liquid is prevented from forming an agglomerate. The reciprocal movement of the diaphragm from its flat state toward not only the pump head side but also the opposite side provides an increased volume of a liquid pumped per stroke, bringing about improved pumping efficiency.

DETAILED DESCRIPTION OF THE INVENTION

The agglomerative liquid pumping method and the recording medium producing method according to the invention will be described in detail based on their preferred embodiments with reference to the accompanying drawings.

Figure 1:
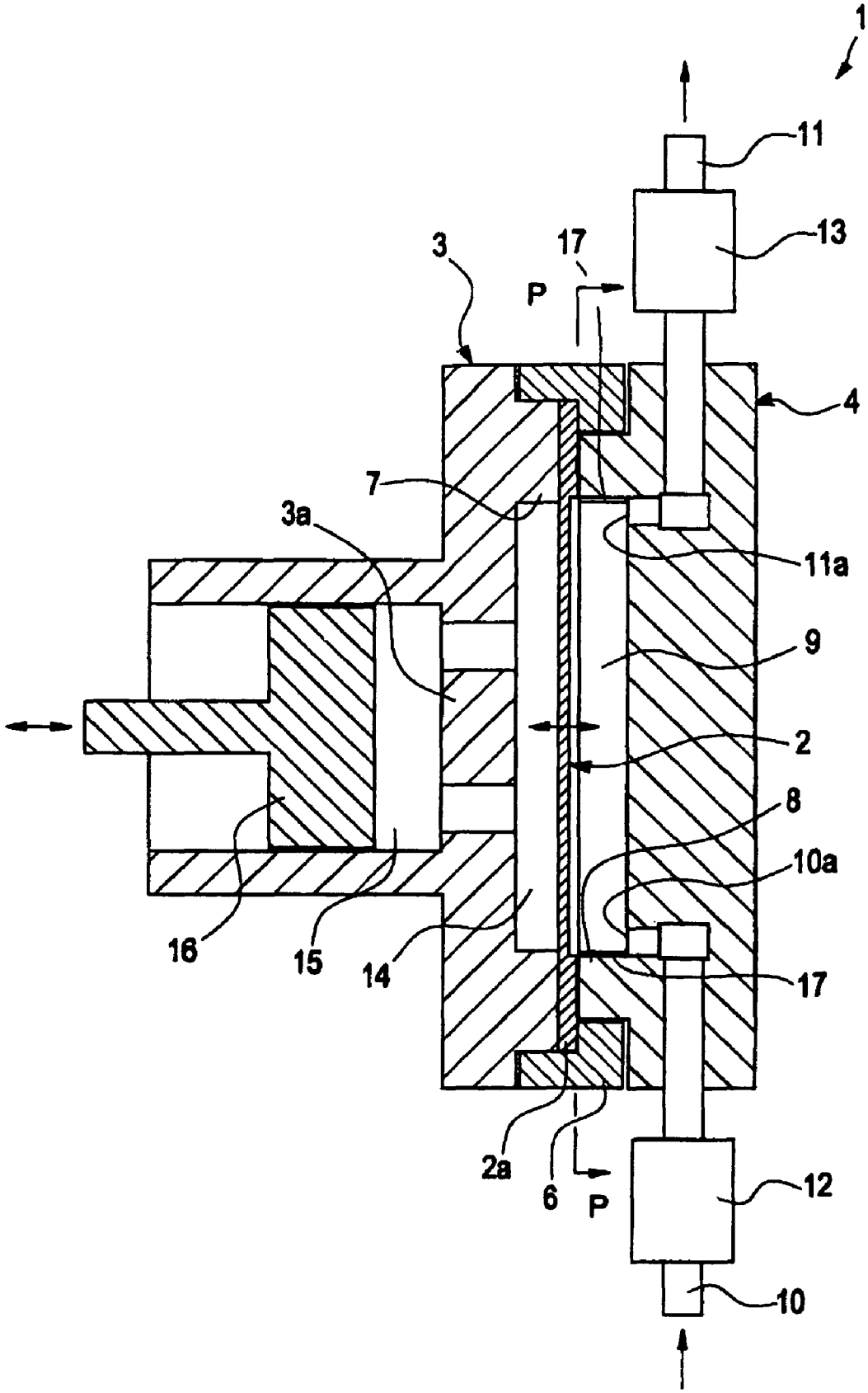
FIG. 1 is a cross-section of a diaphragm pump incorporating a first embodiment of the invention.

FIG. 1 is a cross-section of a diaphragm pump incorporating a first embodiment of the invention. An essential part of FIG. 1 is enlargedly illustrated in FIG. 2. FIG. 3 is a plan of the diaphragm pump of FIG. 1 seen from the pump head side, with the pump head removed. FIG. 4 is a cross-sectional view on arrow P-P in FIG. 1.

As illustrated in FIG. 1, the diaphragm pump 1 of the first embodiment includes a generally disk-shaped diaphragm 2, a pump frame 3 having the diaphragm 2 held therein, and a pump head 4 clamping the peripheral portion of the diaphragm 2 onto the pump frame 3.

While the diaphragm 2 may be made of any material, such as elastic rubber or metal, it is preferred to use a fluororesin, such as Teflon™, for its chemical inertness and processability.

The pump frame 3 is generally circular-cylindrical. The pump frame 3 has on one side thereof an annular projection 7 projecting toward the pump head 4 thereby forming a circular recess. The top surface of the annular projection 7 is in contact with the peripheral portion of the diaphragm 2. An annular holding member 6 is fitted to the outer circumference of the projection 7. The holding member 6 is integrally fixed to the pump head 4 to cover the most peripheral portion of the diaphragm 2. Thus, the annular holding member 6 constitutes a diaphragm holding part (hereinafter "holding member 6") of the pump head 4. The pump head 4 has an annular clamping portion 8 projecting toward the pump frame 3. The clamping portion 8 is in contact with the peripheral portion of the diaphragm 2 radially inward of the holding member 6. The pump frame 3 and the pump head 4 are brought into intimate contact with each other with the diaphragm 2 therebetween by a fastener, such as a bolt.

The pump head 4 is a nearly disk-shaped member that is clamped to the pump frame 3 to close the recess of the pump frame 3. As stated above, the pump head 4 has the annular clamping portion 8, which is fitted on the inner circumference of the holding member 6. The annular clamping portion 8 of the pump head 4 clamps the peripheral portion 2*a* of the diaphragm 2 onto the annular projection 7 of the pump head 3. The diaphragm 2 is thus fixed along its peripheral portion between the pump frame 3 and the pump head 4.

The fixed diaphragm 2 and the pump head 4 define a pump chamber 9. An intake pipe 10 and a discharge pipe 11 are fitted into the pump head 4 such that they are interconnected with the pump chamber 9. The intake pipe 10 is equipped with a check valve 12 allowing a liquid to flow only into the pump chamber 9. The discharge pipe 11 is equipped with a check valve 13 allowing a liquid only to discharge from the pump chamber 9.

The diaphragm pump 1 is configured to cause the diaphragm 2 to reciprocally mode to decrease or increase the volume of the pump chamber 9. With the reciprocal motion of the diaphragm 2, a liquid is made to flow into the pump chamber 9 through the intake pipe 10 and discharged from the pump chamber 9 through the discharge pipe 11, thereby delivering the liquid in the same direction. While, in the example illustrated in FIG. 1, an inlet 10*a* and an outlet 11*a* are independently provided to lead to the intake pipe 10 and the discharge pipe 11, respectively, the pump head 4 may have only one port shared by the intake pipe 10 and the discharge pipe 11. In order to reduce pulsation, the pump chamber 9 may be composed of a plurality of subchambers.

Examples of the means for controlling the reciprocal movement of the diaphragm 2 include a motor, an electromagnet, pressure, and so on. FIG. 1 represents an example in which the reciprocal movement of the diaphragm 2 is controlled by pressure.

The bottom 3*a* of the pump frame 3 and the diaphragm 2 define a working fluid chamber 14. The pump frame 3 has a cylinder chamber 15 communicating with the working fluid chamber 14. The working fluid chamber 14 and the cylinder chamber 15 are filled with a working fluid, such as oil. The pressure applied to the working fluid is controlled by the reciprocating motion of a plunger 16 and directly exerted to the diaphragm 2.

On applying a positive or negative pressure of the working fluid to the diaphragm 2, the diaphragm 2 is deflected because of its elasticity and displaced toward the pump chamber 9 or the working fluid chamber 14. Thus, the volume of the pump chamber 9 decreases or increases, whereby the liquid in the pump chamber 9 is pumped. In using pressure of a working fluid, either gaseous or liquid, the force applied to the diaphragm 2 is evenly distributed over the movable portion of the diaphragm 2. As a result, the diaphragm 2 is prevented from locally deteriorating.

Figure 5:
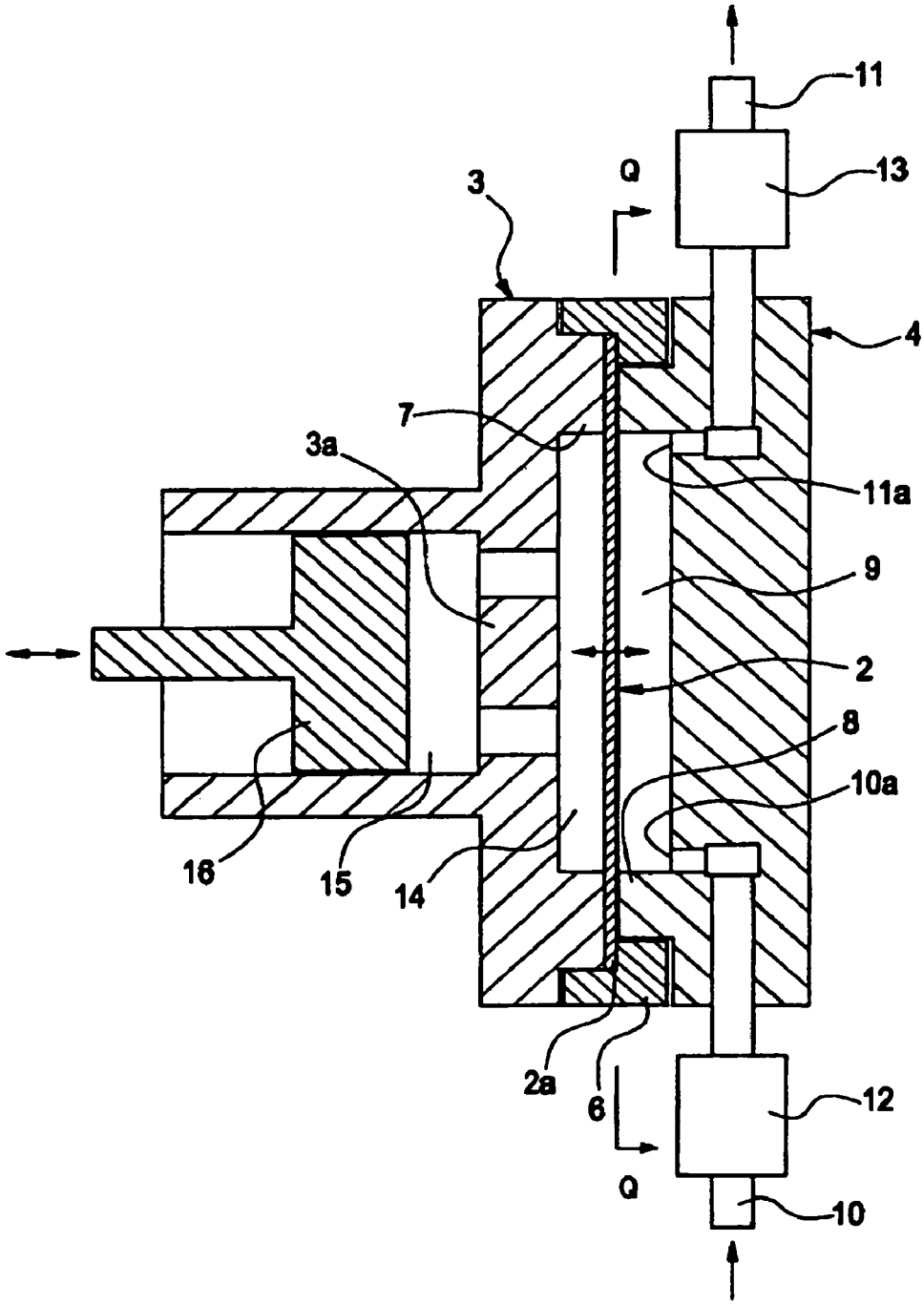
FIG. 5 PRIOR ART
FIG. 5 is a cross-section of a diaphragm pump as a reference example.
Figure 6:
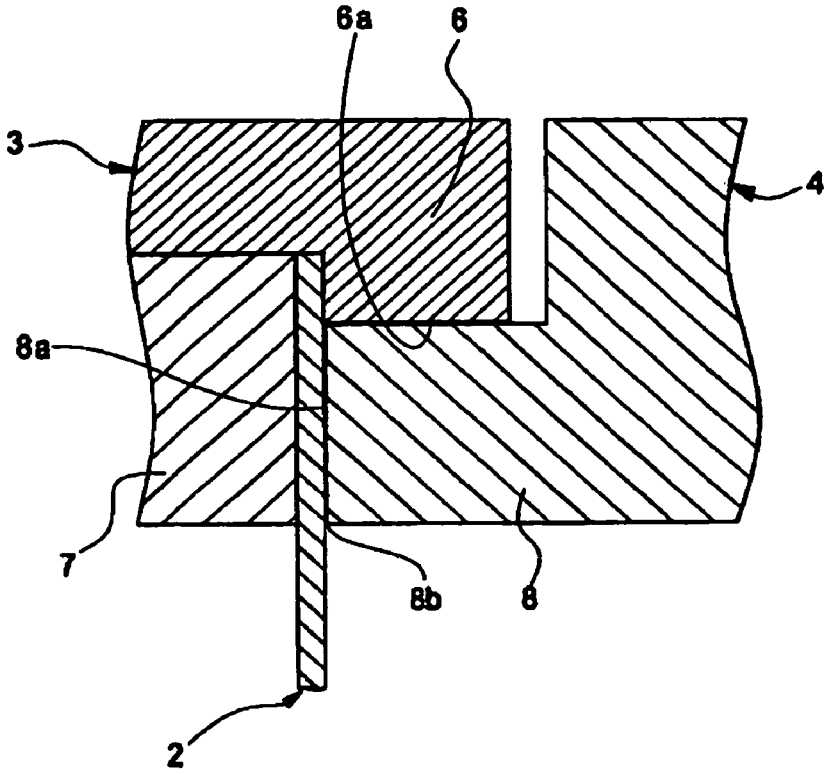
FIG. 6 PRIOR ART
FIG. 6 is an enlarged cross-section of an essential part of the diaphragm pump of FIG. 5.
Figure 7:
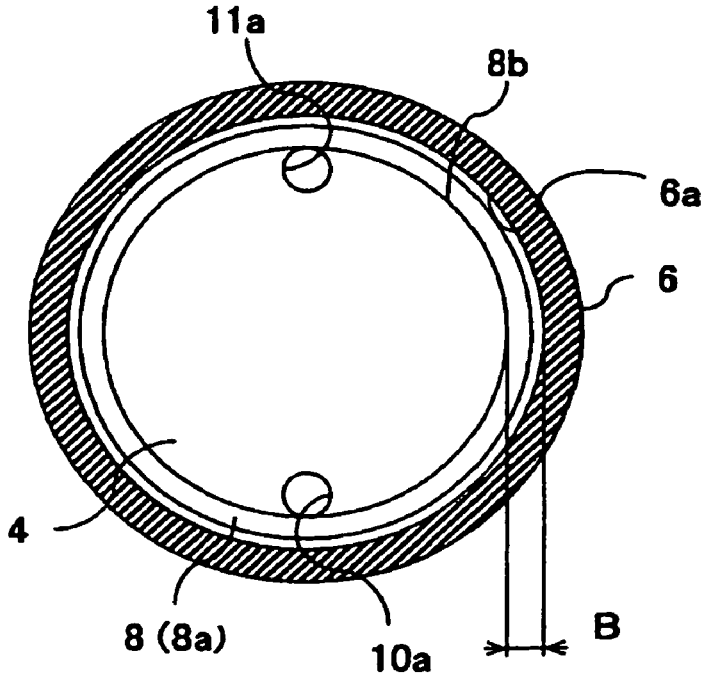
FIG. 7 PRIOR ART
FIG. 7 is a cross-sectional view on arrow Q-Q in FIG. 5.

For reference, a diaphragm pump having a diaphragm 2 with a uniform thickness is shown in FIGS. 5 through 7. FIG. 5 is a cross-section of the diaphragm pump. FIG. 6 is an enlarged cross-section of an essential part of the diaphragm pump. FIG. 7 is a cross-sectional view on arrow Q-Q in FIG. 5.

In the reference example shown in FIGS. 5 to 7, the diaphragm 2 is subjected to strain on repetition of attachment/detachment of the pump head 4 or in long-term operation. In particular, a diaphragm 2 made of a fluororesin, such as Teflon™, is liable to distortion due to cold flow. Distortion of the diaphragm 2 produces a gap between the diaphragm 2 and the pump head 4, where a liquid can stagnate to form agglomerates.

Figure 2:
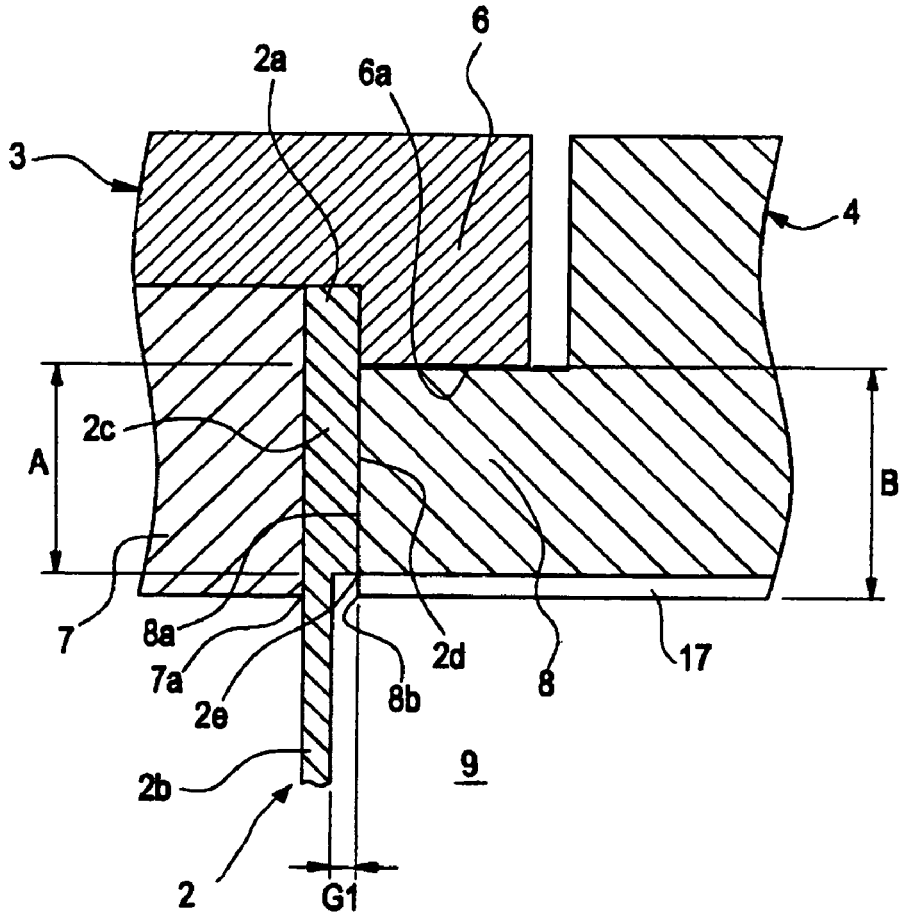
FIG. 2 is an enlarged cross-section of an essential part of the diaphragm pump of FIG. 1.
Figure 3:
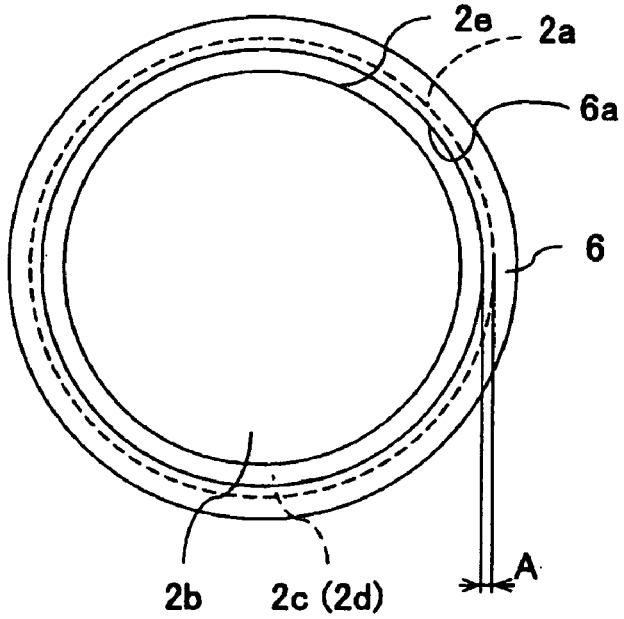
FIG. 3 is a plan of the diaphragm pump of FIG. 1 seen from the side of a pump head, with the pump head removed.
Figure 4:
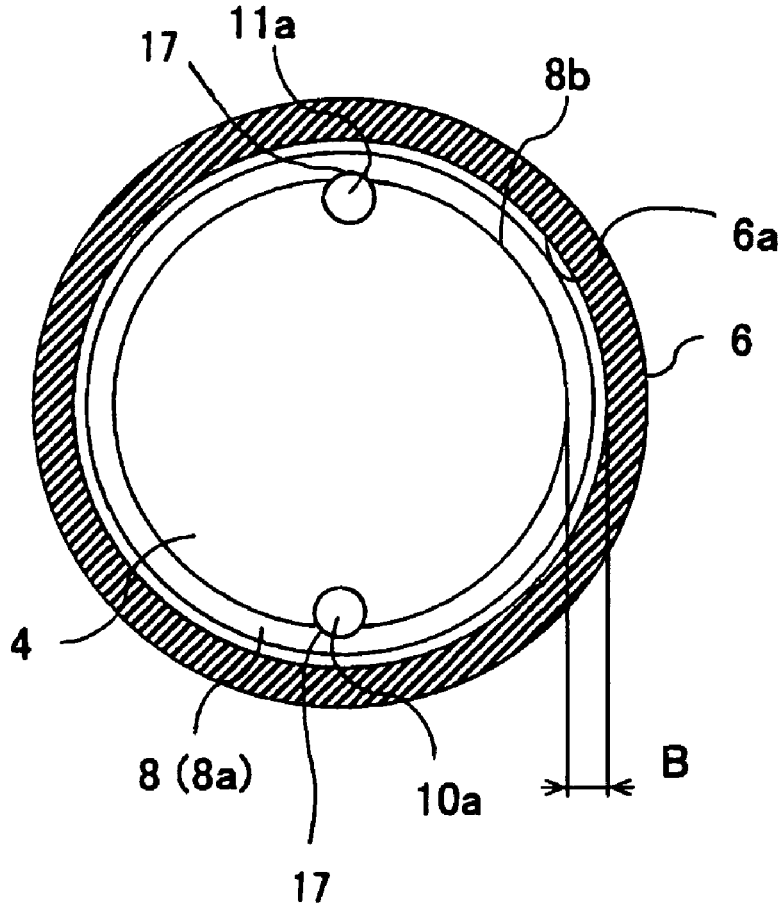
FIG. 4 is a cross-sectional view on arrow P-P in FIG. 1.

According to the first embodiment, in contrast, the diaphragm 2 has an annular thickened portion along its periphery as illustrated in FIGS. 2 and 3. FIG. 2 is an enlarged fragmentary cross-section of the diaphragm pump 1 of FIG. 1, showing the peripheral portion 2*a* of the diaphragm 2 and its surroundings. FIG. 3 is a plan of the diaphragm 2 of FIG. 1 seen from the side of the pump head 4, with the pump head 4 removed.

The diaphragm 2 is composed of a peripheral portion 2*a* and a movable portion 2*b*. As illustrated in FIGS. 2 and 3, the peripheral portion 2*a* is substantially thicker than the movable portion 2*b* to provide an annular thickened portion 2*c* projecting to the side of the pump head 4. The thickened portion 2*c* is clamped between the projection 7 of the pump frame 3 and the clamping portion 8 of the pump head 4 thereby fastened between the pump frame 3 and the pump head 4. While the part of the surface of the peripheral portion 2*a* including the thickened portion 2*c* in contact with the projection 7 of the pump frame 3 and the clamping portion 8 of the pump head 4 is flat, the other part of the surface may be flat or textured.

The maximum distance from (i) the inner periphery 6*a* of the holding member 6 of the pump frame 3 (the surface 6*a* is the innermost periphery in contact with the clamping portion 8 of the pump head 4) to (ii) the inner peripheral edge 2*e* of the thickened portion 2*c* measured on the surface 2*d* of the thickened portion 2*a* clamped by the pump head 4 (the surface 2*d* is the region in contact with the pump head 4) is taken as A. The minimum distance between (i) the inner periphery 6*a* of the holding member 6 and (ii) the inner peripheral edge 8*b* of the clamping surface 8*a* (by which the thickened portion 2*c* of the diaphragm 2 is clamped) of the clamping portion 8 of the pump head 4 as measured on the surface 8*a* in other than the region having a channel 17 communicating the inner peripheral edge 8*b* of the clamping surface 8*a* with the pump chamber 9 is taken as B. The diaphragm clamping mechanism is configured such that A is smaller than B (A<B).

The radially measured distance between the inner periphery 6*a* of the holding member 6 and the inner peripheral edge 7*a* of the projection 7 is nearly equal to the radially measured distance between the inner periphery 6*a* and the inner peripheral edge 8*b* of the pump head 4. With the relation A<B satisfied, the thickened portion 2C of the diaphragm 2 is completely sandwiched between the projection 7 of the pump frame 3 and the clamping portion 8 of the pump head 4. The inner peripheral edge of the thickened portion 2C is thus prevented from sticking out beyond the inner peripheral edge 8*b* into the pump chamber 9. Therefore, no gap will be produced between the thickened portion 2*c* of the diaphragm 2 and the clamping portion 8 of the pump head 4, whereby the agglomeration problem that might otherwise occur is eliminated.

Figure 8:
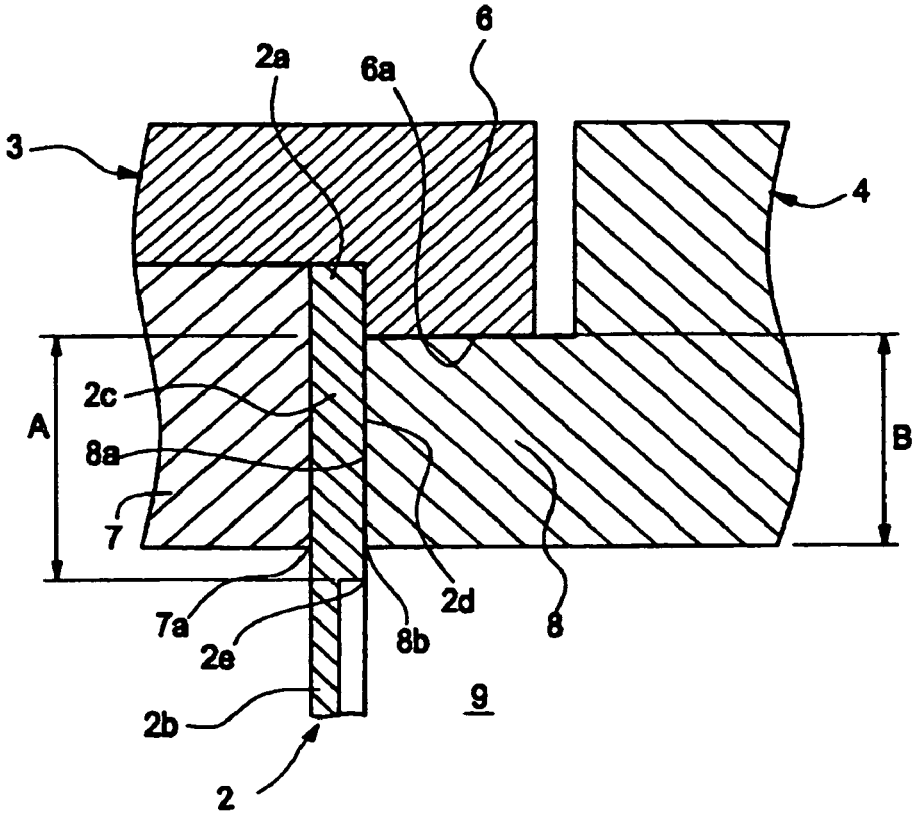
FIG. 8 PRIOR ART
FIG. 8 is a cross-section of an essential part of a diaphragm pump as another reference example.

A reference example in which A>B is illustrated in FIG. 8. In this example, the inner peripheral edge 2*e* of the thickened portion 2*c* sticks out beyond the inner peripheral edge 8*b* of the clamping surface 8*a* toward the pump chamber 9. Similar to the example illustrated in FIGS. 5 and 6, a gap will form between the diaphragm 2 and the pump head 4, in which a liquid may stagnate to cause particles to agglomerate.

Back to FIGS. 1 to 4, when the diaphragm 2 is displaced toward the pump chamber 9, the starting point of the displacement is set at the boundary between the thickened portion 2*c* and the movable portion 2*b* radially inward of and continuous with the thickened portion 2*c*, i.e., the boundary at which the thickness changes. There is formed a gap G1 between the movable portion 2*b* of the diaphragm 2 and the pump head 4 because of the thickness difference of the diaphragm 2. The gap G1 is sufficiently larger than a gap that may form as a result of cold flow. Even if a liquid flows into the gap G1, the liquid in the gap G1 is not subjected to excessive shear force and thereby prevented from causing particles to agglomerate.

The diaphragm pump 1 of the present embodiment is configured to reciprocally displace the diaphragm 2 between the working fluid chamber side and the pump chamber side. When the diaphragm 2 is displaced to the pump chamber 9, the volume of the gap G1 between the movable portion 2*b* of the diaphragm 2 and the pump head 4 contracts. On displacing the diaphragm 2 to the working fluid chamber 14, the volume of the gap G1 expands. With the volume contraction and expansion of the gap G1, the liquid in the gap G1 circulates, whereby the liquid is prevented from stagnating in the gap G1 and forming agglomerates.

The relation A<B is preferably such that A is as close to B as possible. Specifically, B/A is preferably 1.3 or less, more preferably 1.2 or less, even more preferably 1.1 or less. When A is extremely smaller than B, gas may gather in the depth of the gap G1. Nevertheless, the gas gathering is prevented by the provision of a gas vent channel communicating between the inner peripheral edge of the clamping surface 8*a* of the pump head 4 and the pump chamber 9. The gas vent channel may be a channel 17 formed on the inner periphery of the clamping portion 8 of the pump head 4 as illustrated in FIGS. 1, 2, and 4. Such a channel 17 may be provided at least one position in the circumferential direction (two positions in the example of FIG. 4). As previously stated, the distance B is measured in other than the region having the channel 17.

The gap G1 between the movable portion 2*b* of the diaphragm 2 and the pump head 4 is decided depending on the size of the diaphragm 2 and the type of the liquid to be handled. Considering that too small a gap can cause a liquid to stagnate, the gap G1 is preferably at least 0.5 mm. Taking the stability of the pump head 4 into consideration, the gap G1 is preferably 5 mm or less. In order to improve the durability of the diaphragm 2, the boundary between the movable portion 2*b* and the thickened portion 2*c* at which the thicknesses of the diaphragm 2 changes may be rounded to have a curvature.

Compared with a diaphragm pump in which the diaphragm is displaced from its flat state only to the side opposite to the pump chamber 9, the diaphragm pump 1 of the present embodiment, in which the diaphragm 2 is displaced to both the side of the pump chamber 9 and the side of the working fluid chamber 14, delivers an increased volume of a liquid per stroke, thereby bringing about improved pumping efficiency.

Figure 9:
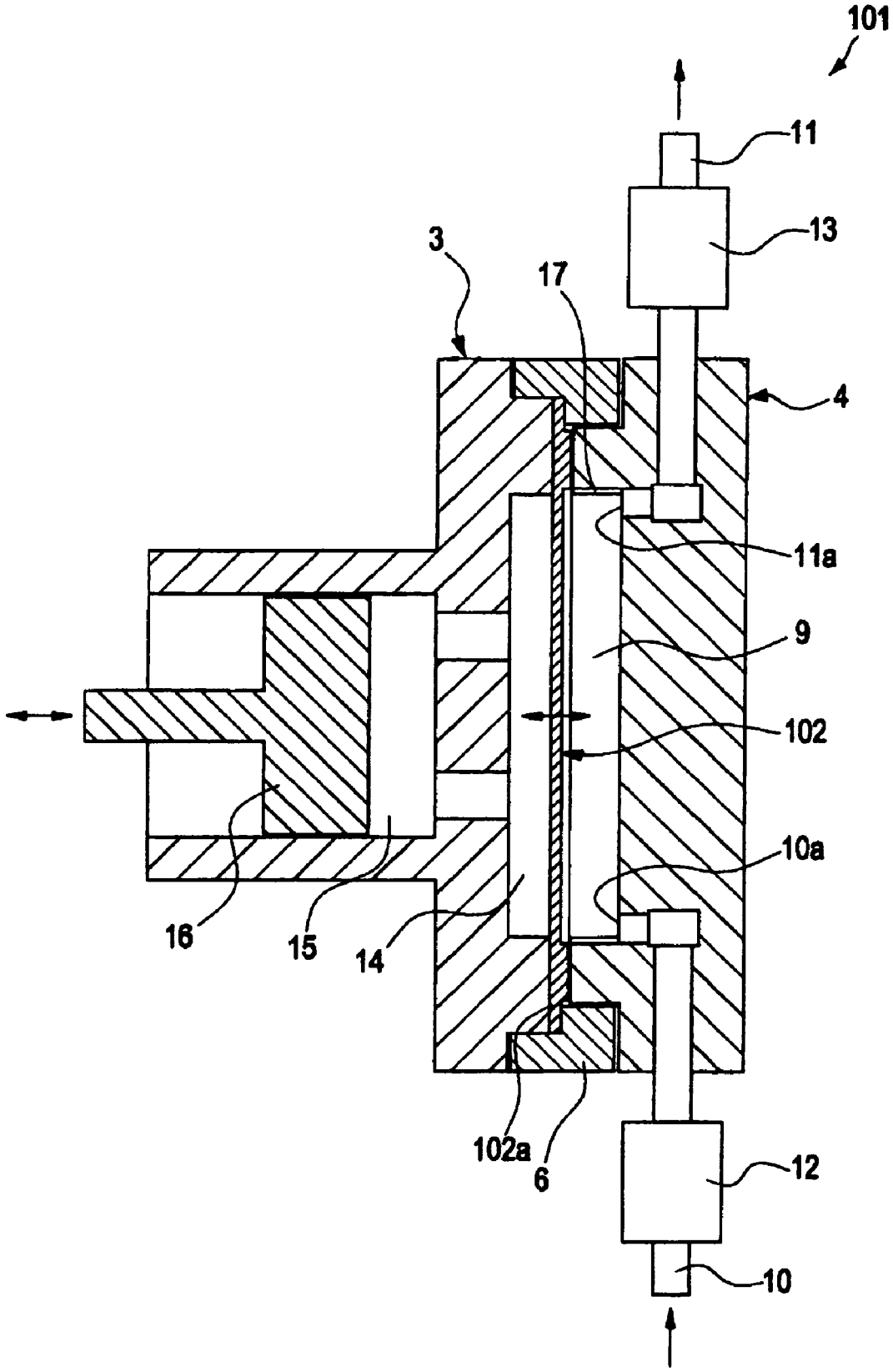
FIG. 9 is a cross-section of a diaphragm pump incorporating a second embodiment of the invention.

FIG. 9 is a cross-section of a diaphragm pump incorporating a second embodiment of the invention. An essential part of the diaphragm pump of FIG. 9 is enlargedly illustrated in FIG. 10. FIG. 11 is a plan of the diaphragm pump of FIG. 9 seen from the pump head side, with the pump head removed. Members identified with the same numerals as in FIGS. 1 through 4 may be identical and will not be redundantly described.

As illustrated in FIG. 9, the diaphragm pump 101 of the second embodiment includes a generally disk-shaped diaphragm 102, a pump frame 3 having the diaphragm 102 held therein, and a pump head 4 clamping the peripheral portion 102*a* of the diaphragm 102 onto the pump frame 3.

Figure 10:
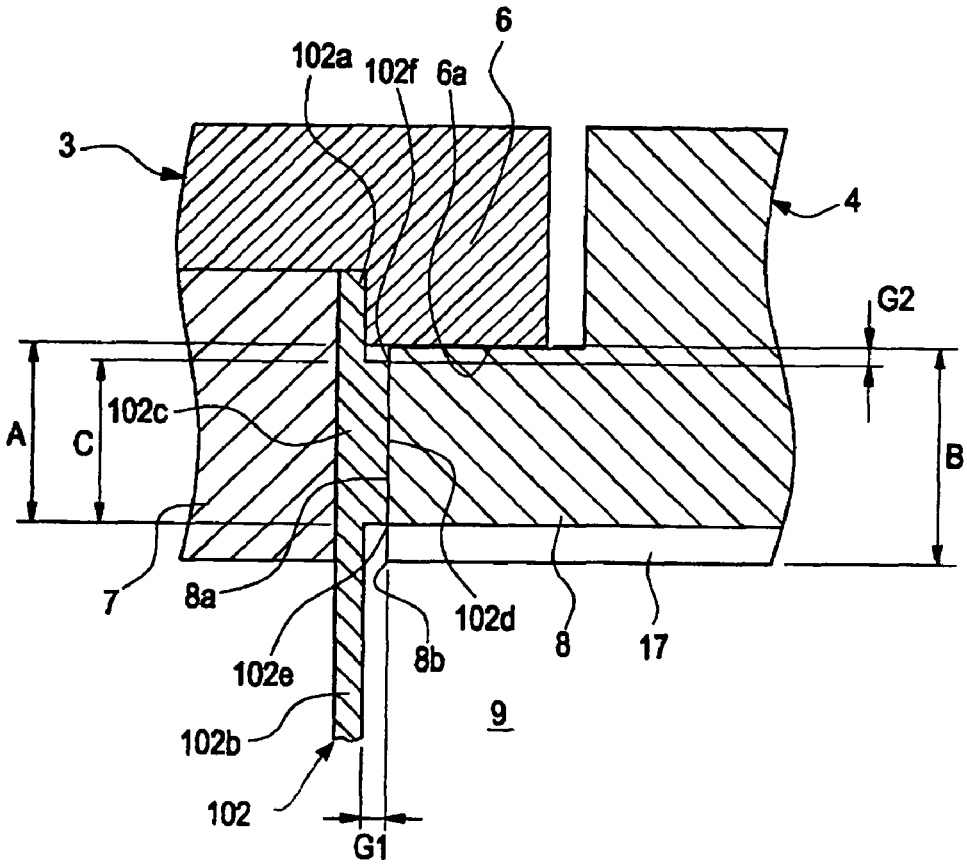
FIG. 10 is an enlarged cross-section of an essential part of the diaphragm pump of FIG. 9.
Figure 11:
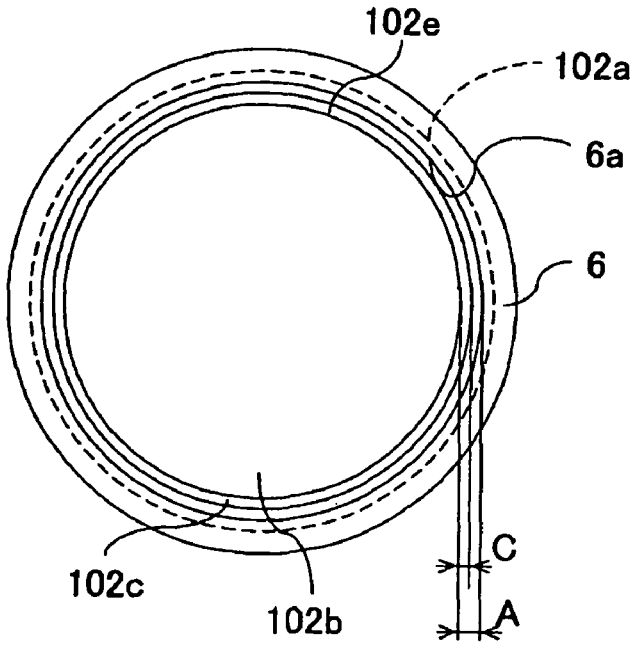
FIG. 11 is a plan of the diaphragm pump of FIG. 9 seen from the side of a pump head, with the pump head removed.

As illustrated in FIGS. 10 and 11, the diaphragm 102 is composed of a peripheral portion 102*a* and a movable portion 2*b* radially inward of the peripheral portion 102*a*. The peripheral portion 102*a* has an annular thickened portion 102*c* that is substantially thicker than the movable portion 102*b* and projects to the side of the pump head 4. The thickened portion 102C is clamped between the projection 7 of the pump frame 3 and the clamping portion 8 of the pump head 4 thereby to fasten the diaphragm 102 between the pump frame 3 and the pump head 4.

The maximum distance from the inner periphery 6*a* of the holding member 6 of the pump frame 3 to the inner peripheral edge 102*e* of the thickened portion 102*c* measured on the surface 102*d* of the thickened portion 102*c* clamped by the pump head 4 (the surface 102*d* is the region in contact with the pump head 4) is taken as A. The minimum distance from the inner periphery 6*a* of the holding member 6 to the inner peripheral edge 8*b* of the clamping surface 8*a* (by which the thickened portion 102*c* of the diaphragm 2 is clamped) of the clamping portion 8 of the pump head 4 as measured on the surface 8*a* in other than the region having a channel 17 communicating the inner peripheral edge 8*b* of the clamping surface 8*a* with the pump chamber 9 is taken as B. The diaphragm clamping mechanism is configured such that A is smaller than B (A<B). The effects of satisfying the relation A<B are the same as in the first embodiment and will not be redundantly described.

The maximum distance between the inner peripheral edge 102*e* and the outer peripheral edge 102*f* measured on the surface 102*d* of the thickened portion 102*c* of the diaphragm 102 is taken as C. The diaphragm clamping mechanism is configured such that C is smaller than A (C<A). With the relation C<A satisfied, a gap G2 is formed between the thickened portion 102*c* of the diaphragm 102 and the inner periphery 6*a* of the holding member 6 of the pump frame 3. When the thickened portion 102*c* is compressed between the projection 7 of the pump frame 3 and the clamping portion 8 of the pump head 4, the gap G2 provides allowance for radially outward deformation of the thickened portion 102*c*, allowing the thickened portion 102*c* to be pressed out radially outwardly while inhibiting the thickened portion 102*c* from being pressed out radially inwardly. Thus, the inner peripheral edge 102*e* of the thickened portion 102*c* is prevented from sticking out beyond the inner peripheral edge 8*b* of the clamping surface 8*a* of the pump head 4 into the pump chamber 9. That is, deformation of the diaphragm 102 is prevented from destroying the relation A<B.

According to the pump structure of the second embodiment, gap formation between the thickened portion 102 of the diaphragm 102 and the clamping portion 8 of the pump head 4 is certainly prevented, making certain that a liquid will not stagnate to form agglomerates.

The diaphragm 102 may have any value C depending on the size of the diaphragm pump 101 but should be decided taking into consideration sealing properties and stability of fixing the pump head 4. Noting that the diaphragm 102 may be generally distorted depending on its thickness, which can result in reduced durability of the diaphragm 102, it is desirable, therefore, that the value C be as large as possible. The relation with respect to A is preferably 0.7<C/A<1, more preferably 0.8<C/A<1, and even more preferably 0.9<C/A<1.

Figure 12:
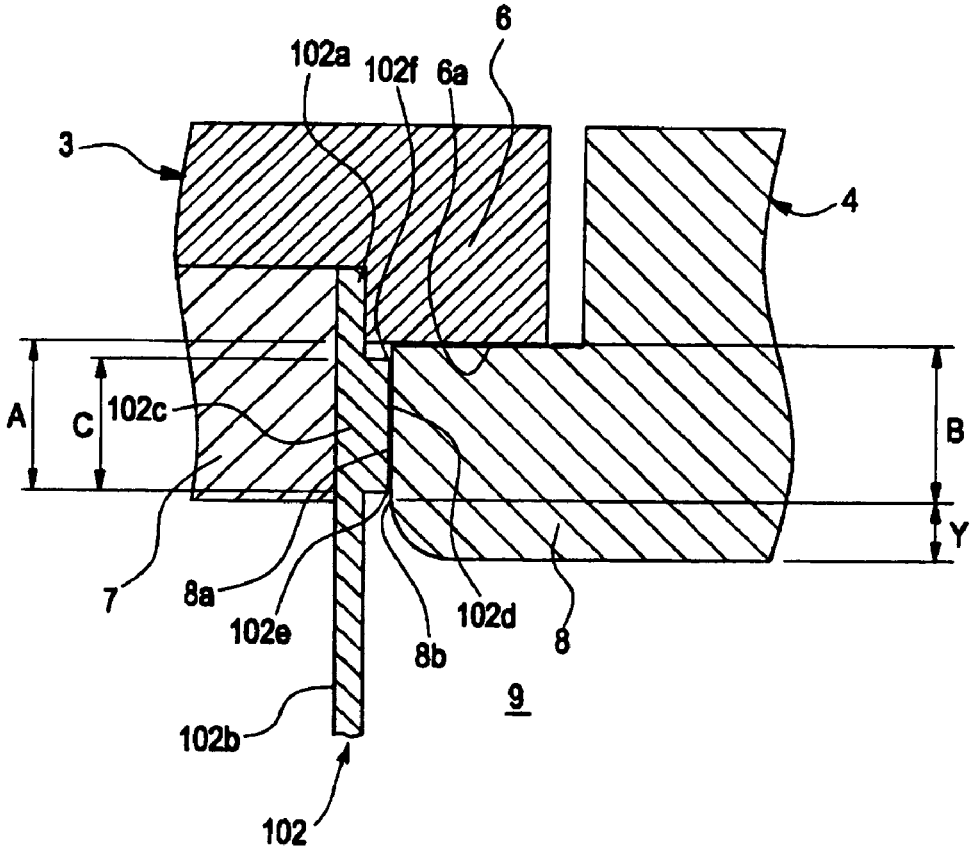
FIG. 12 is a cross-section of an essential part of a diaphragm pump according to a modification of the second embodiment shown in FIG. 9.
Figure 13:
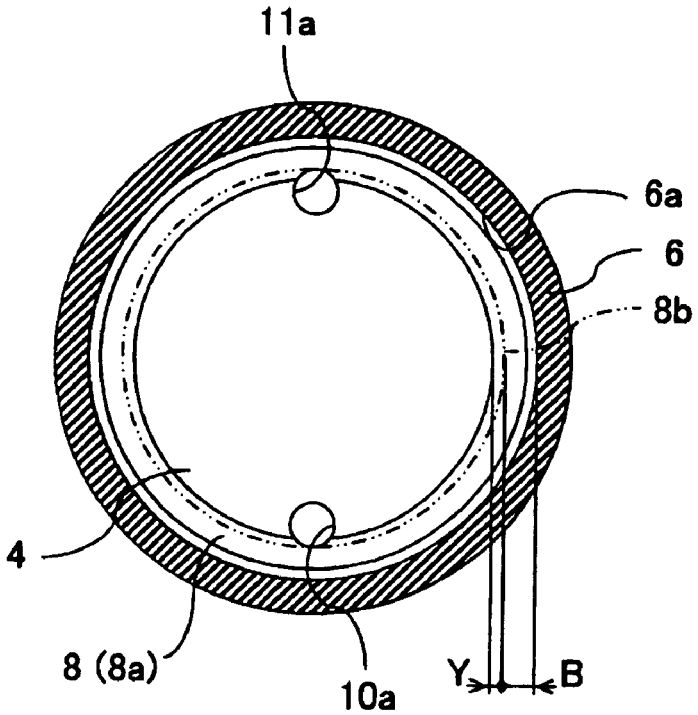
FIG. 13 is a cross-section of the diaphragm pump of FIG. 12.

FIGS. 12 and 13 represent a modification of the second embodiment. FIG. 12 is an enlarged cross-section of an essential part of a diaphragm pump, and FIG. 13 is a cross-section of the diaphragm pump of FIG. 12.

As illustrated in FIGS. 12 and 13, the inner peripheral edge of the clamping portion 8 of the pump head 4 may be rounded with a given curvature for the purpose of improving the durability of the diaphragm 102. The portion indicated by Y is the portion with a rounded edge. The portion Y does not take part in clamping the thickened portion 102C of the diaphragm 102. Therefore, the value B, defined to be the minimum distance from the inner periphery 6*a* of the holding portion 6 of the pump frame 3 to the inner peripheral edge 8*b* of the clamping surface 8*a*, does not include the size of the portion Y.

If such a clamping portion 8 having a curvature along its inner peripheral edge is combined with a diaphragm having no thickened portion, a sharply angled, small gap forms between the portion Y and the diaphragm, where a liquid stagnates to form an agglomerate. Such small gap formation is avoided by using the diaphragm 102 with the thickened portion 102C, whereby formation of an agglomerate is prevented.

As described, the diaphragm pump structure according to the invention is capable of pumping a variety of agglomerative liquids, such as a concentrated liquid or a suspension, while inhibiting formation of agglomerates. The effect is particularly conspicuous in pumping a suspension exemplified by a polymer latex. As used herein the term "latex" refers to a colloidal dispersion or emulsion of microparticles of a polymer (natural or synthetic rubber or plastic) dispersed in an aqueous medium by the action of an emulsifying agent. Latices are classified according to the method of production into (1) natural latices: naturally occurring products resulting from metabolism of plants, such as natural rubber latex; (2) synthetic latices: systems produced from corresponding monomers by emulsion polymerization, such as a polystyrene latex and an SBR latex; and (3) artificial latices: systems obtained by dispersing a solid polymer in an aqueous medium, such as a butyl rubber latex and a regenerated rubber latex.

Examples of polymer latices that can be used in the invention include latices of acrylic polymers, polyesters, rubbers (e.g., SBR resin), polyurethanes; polyvinyl chloride copolymers, such as vinyl chloride-vinyl acetate copolymers, vinyl chloride-acrylic ester copolymers, and vinyl chloride-methacrylic acid copolymers; vinyl acetate copolymers, such as ethylene-vinyl acetate copolymers; and polyolefins. The latex polymers may be linear polymers or branched polymers, or crosslinked polymers, and homopolymers or copolymers. The copolymers may be random copolymers or block copolymers. The number average molecular weight of the polymers is preferably 5000 to 1,000,000, more preferably 10,000 to 500,000.

One, or a combination of two or more, of polyester latices and the vinyl chloride copolymer latices, such as vinyl chloride-acrylic compound copolymer latices, vinyl chloride-vinyl acetate copolymer latices, and vinyl chloride-vinyl acetate-acrylic compound copolymer latices, may be used.

Examples of commercially available vinyl chloride copolymer latices include Vinyblan series (Vinyblan 240, 270, 276, 277, 375, 380, 386, 410, 430, 432, 550, 601, 602, 609, 619, 680, 680S, 681N, 683, 685R, 690, 860, 863, 685, 867, 900, 938, and 950) from Nisshin Chemical Industry Co., Ltd.; and SE1320 and S-830 from Sumitomo Chemtec. Examples of commercially available polyester latices include Vylonal series (Vylonal MD1200, MD1220, MD1245, MD1250, MD1500, MD1930, and MD1985) from Toyobo Co., Ltd.

Preferred of the above recited polymer latices are vinyl chloride copolymer latices, such as vinyl chloride/acrylic compound copolymer latices, vinyl chloride/vinyl acetate copolymer latices, and vinyl chloride/vinyl acetate/acrylic compound copolymer latices.

The diaphragm that can be used in the invention is preferably made of polytetrafluoroethylene (PTFE). Other materials also useful to make the diaphragm are ethylene-propylene-diene rubber (EPDM), nitrile rubber (NBR), epichlorohydrin rubber (CO/ECO), and stainless steel.

The diaphragm pump of the present invention is suited to pump an inkjet recording material, an electrophotographic recording material, thermal transfer image receiving material, or a heat developable photosensitive material. These materials can be delivered using the diaphragm pump of the invention to produce the corresponding recording media without involving the problem of agglomerate formation. The present invention thus allows for image formation free from image deterioration resulting from agglomerates.

EXAMPLES

The present invention will now be illustrated in greater detail with reference to Examples, but it should be understood that the invention is not limited thereto.

In Examples, the method of pumping an agglomerative liquid according to the invention was applied to the delivery of an image-forming coating composition, i.e., an inkjet recording material, an electrophotographic recording material, a thermal transfer image-receiving material, and a heat developable photosensitive material. A diaphragm pump available from Nikkiso Co., Ltd. (model: C22X-1.5 F-40D1ESP) equipped with each of the diaphragms shown in Tables 1 to 4 below was used. Unless otherwise specified, diaphragms made of PTFE were used. A temperature-controllable, feed tank was connected to the intake pipe of the diaphragm pump for liquid feed. The discharge pipe of the diaphragm pump was connected via a needle valve for secondary pressure control to the feed tank, so that a liquid might circulate for an extended period of time.

Each material (image-forming coating composition) described below was circulated under the following conditions. The secondary pressure and the temperature were adjusted at 0.5 Mpa and 40° C. The material was circulated at a flow rate of 500 cc/min for consecutive 24 hours and, immediately thereafter, transferred to application equipment and applied to a substrate or a medium.

After the pump was emptied, all the precipitate adhering to the diaphragm and the head was collected and filtered to separate agglomerates, which were dried spontaneously and weighed. The diaphragm pump used had two pumping cavities. The total weight of the agglomerates collected from the two pumping cavities was obtained. The results are shown in Tables 1 through 4.

Unless otherwise noted, all the parts, percents, and ratios are given by weight.

Examples 1 to 3 and Comparative Examples 1 and 2

Preparation of Inkjet Recording Material (a) Preparation of Substrate

Wood pulp (LBKP, 100 parts) was beaten in a double disk refiner to a CSF of 300 ml. To the pulp were added 0.5 parts of epoxidized behenamide, 1.0 part of anionic polyacrylamide, 0.1 parts of polyamide polyamine epichlorohydrin, and 0.5 parts of cationic polyacrylamide on an absolute dry mass basis. The resulting stock was formed into paper having a grammage of 170 g/m$^2$ on a Fourdrinier paper machine.

The paper was sized by impregnating with 0.5 g/m$^2$ (on an absolute dry mass basis) of a 4% aqueous solution of polyvinyl alcohol containing 0.04% of a fluorescent whitening agent (Whitex BB, from Sumitomo Chemical Co., Ltd.).

After drying, the paper was calendered to a density of 1.05 g/cc.

The paper was subjected to a corona discharge treatment on its wire side, and high-density polyethylene was applied thereon to a thickness of 38 μm using a melt extruder to form a matte resin layer. The side of the paper with the matte resin layer will be referred to as a back side. The resin layer was subjected to a corona discharge treatment, and a dispersion of aluminum oxide (Alumina Sol 100, from Nissan Chemical Industries, Ltd.) and silicon dioxide (Snowtex O, from Nissan Chemical) in a ratio of 1:2 in water was applied thereon as an antistatic agent to an absolute dry mass of 0.2 g/m$^2$.

The felt side of the paper (the side with no resin layer) was subjected to a corona discharge treatment. Low-density polyethylene having a melt flow rate of 3.8 and containing 10% of anatase titanium oxide, a trace amount of ultramarine, and 0.01% of a fluorescent whitening agent (based on the polyethylene) was extrusion coated on the felt side to a thickness of 40 μm using a melt extruder to form a high gloss thermoplastic resin layer. The gloss layer side of the paper will be referred to as a face side.

(b) Preparation of Coating Composition A for Ink Receiving Layer

Formulation:

| | | |
|---|---|---|
| (1) | Fumed silica (inorganic particles) (Aerosil 300SF75, from Nippon Aerosil) | 8.9 parts |
| (2) | Ion exchanged water | 56.0 parts |
| (3) | Dispersing agent (51.5% aqueous solution of Shallol DC-902P, from Dai-ichi Kogyo Seiyaku Co., Ltd.) | 0.78 parts |
| (4) | Zirconium acetate (ZA-30, from Daiichi Kigenso Kagaku Kogyo Co., Ltd.) | 0.48 parts |
| (5) | Boric acid (crosslinking agent) | 0.4 parts |
| (6) | Polyvinyl alcohol (water soluble resin) solution having the following composition: | 31.2 parts |
| | Polyvinyl alcohol (PVA235, from Kuraray Co., Ltd.; degree of saponification: 88%; degree of polymerization: 3500) | 2.17 parts |
| | Polyoxyethylene lauryl ether (surfactant) (Emulgen 109P, from Kao Corp.; 10% aqueous solution; HLB: 13.6) | 0.07 parts |
| | Diethylene glycol monobutyl ether (Butycenol 20P, from Kyowa Hakko Chemical Co., Ltd.) | 0.66 parts |
| | Ion exchanged water | 28.2 parts |
| (7) | Cationic modified polyurethane (Superflex 650, from Dai-ichi Kogyo Seiyaku) | 2.2 parts |
| (8) | Ethanol | 1.17 parts |

Components (1) to (4) above were mixed, and the mixture was homogenized in one pass through a high pressure homogenizer (Multimizer, from Sugino Machine Limited) at 130 mPa. The dispersion was heated to 45° C., at which it was maintained for hours. The dispersion was mixed with the other components (5) to (8) at 30° C. to prepare coating composition A for ink receiving layer.

(c) Preparation of Inkjet Recording Medium

The face side of the substrate prepared in (a) above was subjected to a corona discharge treatment. The thus treated face side of the substrate was coated with an in-line mixed mixture of 210 g/m$^2$ of coating composition A prepared in (b) above and 10.8 g/m$^2$ of poly(aluminum chloride) (Alufine 83, from Daimei Chemical Co., Ltd.) 5-fold diluted with water. As previously stated, the coating composition A was used after it had been circulated in each of the diaphragm pumps shown in Table 1 for 24 hours. The coating layer was dried in a hot air dryer at 80° C. and at an air velocity of 3 to 8 m/sec until the solids concentration of the coating layer decreased to 20%. During this drying period, the coating layer dried at a constant drying rate. Immediately thereafter, the coating layer was immersed in mordant solution B having the following formulation for 30 seconds to provide 15 g/m$^2$ of the mordant solution, followed by drying. There was obtained an inkjet recording medium having a 32 μm thick ink-receiving layer.

Formulation of Mordant Solution B:

| | |
|---|---|
| Boric acid | 0.65 parts |
| Zirconium ammonium carbonate (Zircosol AC-7, from Daiichi Kigenso Kagaku Kogyo Co., Ltd.) | 2.5 parts |
| Ammonium carbonate (1st grade, from Kanto Chemical Co., Inc.) | 5.0 parts |
| Ion exchanged water | 85.8 parts |
| Polyoxyethylene lauryl ether (surfactant) (Emulgen 109P, from Kao Corp.; 10% aqueous solution; HLB: 13.6) | 6.0 parts |

The resulting inkjet recording medium was printed with an ordinary scenery image on an inkjet printer (PM-G800, from Seiko Epson Corp.), and the printed image was scored by a panel of five members according to the following scoring system. The results obtained are shown in Table 1.

Scoring System:

5: The image is good with no defects.

4: The image shows slight color unevenness but is free of white spots and acceptable for practical use.

3: A fine white streak(s) is observed in a high density area (with an optical density of 2.0±0.1) to a practically unacceptable level.

2: A noticeable white streak(s) is observed in a high density area (with an optical density of 2.0±0.1) to a practically unacceptable level.

1: A noticeable white streak(s) is observed in not only a high density area but a medium density area (with an optical density of 1.0±0.1) to a practically unacceptable level.

TABLE 1

| | A (mm) | B (mm) | A < B | C (mm) | C < A | Amount of Agglomerate | Image Quality |
|---|---|---|---|---|---|---|---|
| Comp. Example 1 | — | 9.7 | — | — | — | 40 | 2 |
| Comp. Example 2 | 13.5 | 9.7 | no | — | — | 37 | 3 |
| Example 1 | 8.5 | 9.7 | yes | — | — | 2 | 4 |
| Example 2 | 9.2 | 9.7 | yes | 6 | yes | 0 | 5 |
| Example 3 | 8 | 9.7 | yes | 7 | yes | 0 | 5 |

The diaphragm used in Comparative Example 1 had no thickened portion, so that there was no A value (indicated by a minus mark in Table 1). The C values of the diaphragms having no gap G2 were similarly indicated by a minus mark.

Examples 2 and 3 where both relations A<B and C<A are satisfied demonstrate good results in terms of amount of agglomerate and image quality. In Example 1 where only the relation A<B is satisfied, the amount of agglomerate precipitated was 2 mg, which is no problem for practical use. On the other hand, Comparative Examples 1 and 2 which fail to satisfy the relation A<B are problematical in amount of agglomerate and image quality.

Examples 4 to 6 and Comparative Examples 3 and 4

Preparation of Electrophotographic Recording Material (a) Preparation of Substrate Wood pulp (LBKP) was beaten in a conical refiner to a CSF of 340 ml to prepare pulp having an average fiber length of 0.63 mm. To the pulp were added 1.0% of cationic starch, 0.5% of an alkyl ketene dimer (AKD, the alkyl moiety of which was derived from fatty acids mainly comprising behenic acid), 0.3% of anionic polyacrylamide, 5% of titanium dioxide, and 3% of sodium carboxymethylcellulose (CMC, water swellable, degree of etherification: 0.25, average particle size: 20 μn) each based on the mass of the pulp. The resulting stock was formed into a wet web having a grammage of 160 g/m$^2$ using a Fourdrinier paper machine. The wet web was sandwiched between filter paper, passed through a wet press, and dried using a cylinder drier. The resulting paper was calendered using a soft calender between a metal roll having a surface temperature of 250° C., to which the face side of paper (the side where an image recording layer was to be provided) was applied, and a resin roll having a surface temperature of 40° C., to which the opposite side of the web was applied.

The face side of the paper thus obtained was subjected to a corona discharge treatment. A high density polyethylene (HDPE) having a melting point of 133° C. and a low density polyethylene (LDPE) were co-applied onto the face side of the paper by melt extrusion using a co-extruder to form a lower coating layer with a thickness of 12 μm and an upper coating layer with a thickness of 15 μm, respectively.

The opposite side of the paper was subjected to a corona discharge treatment, and HDPE was applied thereon by melt extrusion to form a polymer coating layer with a thickness of 25 μm.

(b) Preparation of Electrophotographic Image Receiving Sheet

An image receiving sheet for electrophotography was prepared using the resulting substrate as follows.

(b-1) Preparation of Titanium Dioxide Dispersion A

Titanium dioxide (TIPAQUE™ A-220, from Ishihara Sangyo Kaisha, Ltd.) (40.0 g), 2.0 g of polyvinyl alcohol (PVA102, from Kuraray Co., Ltd.), and 58.0 g of ion exchanged water were mixed. The mixture was dispersed in a non-bubbling kneader (NBK-2, from Nissei Corp.) to prepare titanium dioxide dispersion A having a titanium dioxide pigment content of 40%.

(b-2) Preparation of Coating Composition for Toner Receiving Layer

The components below were mixed by agitation to prepare a coating composition for toner receiving layer.

| | | |
|---|---|---|
| (1) | Titanium dioxide dispersion A | 15.5 parts |
| (2) | Carnauba wax dispersion (latex dispersion) (Cellosol 524, from Chukyo Yushi Co., Ltd.) | 15.0 parts |
| (3) | Polyester resin aqueous dispersion (latex dispersion) (solid content: 30%, KZA-7049, from Unitika Ltd.) | 100.0 parts |
| (4) | Thickener (Alcox E30, from Meisei Chemical Works, Ltd.) | 2.0 parts |
| (5) | Anionic surfactant (AOT) | 0.5 parts |
| (6) | Ion exchanged water | 80 parts |

(b-3) Preparation of Coating Composition for Backcoating Layer

The components below were mixed by agitation to prepare a coating composition for backcoating layer.

| | | |
|---|---|---|
| (1) | Acrylic resin aqueous dispersion (solid content: 30%, Hyros XBH-997L, from Seiko PMC Corp.) | 100.0 parts |
| (2) | Matting agent (Techpolymer MBXC-12, from Sekisui Chemical Industries Co., Ltd.) | 5.0 parts |
| (3) | Release agent (Hydrin D337, from Chukyo Yushi Co., Ltd.) | 10.0 parts |
| (4) | Thickener (CMC) | 2.0 parts |
| (5) | Anionic surfactant (AOT) | 0.5 parts |
| (6) | Ion exchanged water | 80 parts |

(b-4) Preparation of Image Receiving Sheet

The coating composition for backcoating layer was applied to the back side of the substrate with a bar coater to a dry thickness of 9 g/m$^2$ to form a backcoating layer.

The coating composition for toner receiving layer was applied to the face side of the substrate with a bar coater to a dry thickness of 12 g/m$^2$ to form a toner receiving layer. As previously stated, the coating composition for toner receiving layer was applied after it had been circulated in each of the diaphragm pumps shown in Table 2 for 24 hours. The pigment content in the toner receiving layer was 5% based on the thermoplastic resin.

The coated web was dried online by blowing hot air. The air flow rate and temperature conditions for drying were controlled so that both the backcoating layer and the toner receiving layer might dry within 2 minutes after application. The position in the drying zone at which the coating surface temperature became equal to the wet bulb temperature of drying hot air was taken as a dry point. The coated web was calendered using a gloss calender at a metal roller temperature of 40° C. and a nip pressure of 14.7 kN/cm$^2$ (15 kgf/cm$^2$).

(c) Image Formation and Evaluation

The resulting electrophotographic image receiving sheet web was cut into A4 (210 mm×297 mm) size sheets. The cut sheet was printed on a full color laser printer (DCC-500, from Fuji Zerox Co., Ltd.) with a stepwise pattern comprising 16 steps of black, yellow, magenta, and cyan.

The electrophotographic prints obtained were evaluated for image evenness and rated 1 to 5 by five testers according to the following scoring system where 5 is the best.

Scoring System:

5: Good image quality with no unevenness.

4: Subtle unevenness sometimes occurs in black images but is acceptable for practice use.

3: Slight unevenness occurs in black or magenta images, which is sometimes unacceptable for practice use.

2: Noticeable unevenness occurs in black or magenta images to a degree unacceptable for practical use.

1: Noticeable unevenness occurs generally to a degree unacceptable for practical use.

TABLE 2

| | A (mm) | B (mm) | A < B | C (mm) | C < A | Amount of Agglomerate | Image Quality |
|---|---|---|---|---|---|---|---|
| Comp. Example 3 | — | 9.7 | — | — | — | 34 | 2 |
| Comp. Example 4 | 10.7 | 9.7 | no | — | — | 29 | 3 |
| Example 4 | 8.5 | 9.7 | yes | — | — | 0 | 5 |

TABLE 2-continued

| | A (mm) | B (mm) | A < B | C (mm) | C < A | Amount of Agglomerate | Image Quality |
|---|---|---|---|---|---|---|---|
| Example 5 | 9.2 | 9.7 | yes | 6 | yes | 0 | 5 |
| Example 6 | 8 | 9.7 | yes | 7 | yes | 0 | 5 |

Example 4 wherein the relation A<B is satisfied and Examples 5 and 6 where both the relations A<B and C<A are satisfied demonstrate good results in terms of amount of agglomerate and image quality. On the other hand, Comparative Examples 3 and 4 which fail to satisfy the relation A<B are problematical in amount of agglomerate and image quality.

Examples 7 to 9 and Comparative Examples 5 and 6

Preparation of Thermal Transfer Image Receiving Material (a) Preparation of Thermal Transfer Image Receiving Sheet A paper substrate laminated on both sides with polyethylene was subjected to a corona discharge treatment. A gelatin primer layer containing sodium dodecylbenzenesulfonate was formed on the substrate. A undercoating layer, a heat insulating layer, a lower image receiving layer, an upper image receiving layer, the formulations of which are described below, were simultaneously applied in layer relationship in the order described onto the substrate using the apparatus illustrated in FIG. 9 of U.S. Pat. No. 2,761,791. As previously stated, each of the image-forming coating compositions for the lower and the upper image receiving layers was applied after it had been circulated in the above-described diaphragm pump for 24 hours. These layers were formed with dry thicknesses of 6.5 g/m$^2$ (undercoating layer), 8.8 g/m$^2$ (heat insulating layer), 2.6 g/m$^2$ (lower image receiving layer), and 2.6 g/m$^2$ (upper image receiving layer). In the following formulations, all the parts are by mass on solid basis.

Upper Image Receiving Layer:

| | |
|---|---|
| Vinyl chloride latex (Vinyblan 900, from Nisshin Chemical Industry Co., Ltd.) | 21.0 parts |
| Vinyl chloride latex (Vinyblan 276, from Nisshin Chemical Industry Co., Ltd.) | 2.9 parts |
| Gelatin (10% aqueous solution) | 2.0 parts |
| Ester wax EW-1 (see below) | 2.0 parts |
| Surfactant F-1 (see below) | 0.07 parts |
| Surfactant F-2 (see below) | 0.36 parts |

Lower Image Receiving Layer:

| | |
|---|---|
| Vinyl chloride latex (Vinyblan 690, from Nisshin Chemical Industry Co., Ltd.) | 11.0 parts |
| Vinyl chloride latex (Vinyblan 900, from Nisshin Chemical Industry Co., Ltd.) | 13.0 parts |
| Gelatin (10% aqueous solution) | 10.0 parts |
| Surfactant F-1 | 0.04 parts |

Heat Insulating Layer:

| | |
|---|---|
| Hollow polymer latex (Nipol MH5055, from Zeon Corp.) | 60.0 parts |
| Gelatin (10% aqueous solution) | 30.0 parts |

Undercoating Layer:

| | |
|---|---|
| Polyvinyl alcohol (Poval PVA205, from Kuraray Co., Ltd.) | 6.7 parts |
| Styrene-butadiene rubber latex (SN-307, from Nippon A & L, Inc.) | 60.0 parts |
| Surfactant F-1 | 0.03 parts |

(EW-1)

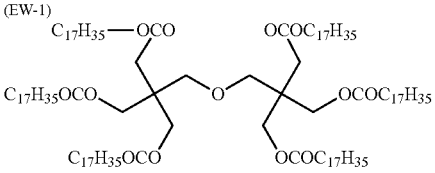

(F-1)

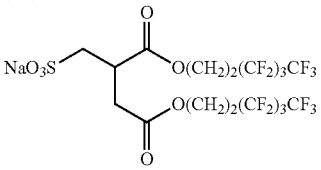

F-2

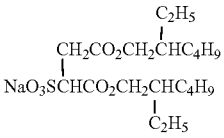

(b) Image Formation and Evaluation

A set of the resulting image receiving sheets were continuously printed with ten ordinary scenery images using an ink sheet (Thermal Photo Paper Set RT-D2T1200, from Fujifilm Corp.) on a thermal transfer printer (ASK-2000, from Fujifilm Corp.), and the prints were scored by a panel of five members according to the following scoring system. The results are shown in Table 3.

Scoring System:

5: The image is good with no defects.

4: The image shows slight color unevenness but is free of white spots and acceptable for practical use.

3: A fine white spot(s) is observed in a high density area (with an optical density of 2.0±0.1) to a practically unacceptable level.

2: A noticeable white spot(s) is observed in a high density area (with an optical density of 2.0±0.1) to a practically unacceptable level.

1: A noticeable white spot(s) is observed in not only a high density area but a medium density area (with an optical density of 1.0+0.1) to a practically unacceptable level.

TABLE 3

| | A (mm) | B (mm) | A < B | C (mm) | C < A | Amount of Agglomerate | Image Quality |
|---|---|---|---|---|---|---|---|
| Comp. Example 5 | — | 9.7 | — | — | — | 58 | 2 |
| Comp. Example 6 | 15.2 | 9.7 | no | — | — | 38 | 3 |

TABLE 3-continued

| | A (mm) | B (mm) | A < B | C (mm) | C < A | Amount of Agglomerate | Image Quality |
|---|---|---|---|---|---|---|---|
| Example 7 | 8.5 | 9.7 | yes | — | — | 3 | 4 |
| Example 8 | 9.2 | 9.7 | yes | 6 | yes | 0 | 5 |
| Example 9 | 8 | 9.7 | yes | 7 | yes | 0 | 5 |

Examples 8 and 9 where both the relations A<B and C<A are satisfied demonstrate good results in terms of amount of agglomerate and image quality. In Example 7 where only the relation A<B is satisfied, the amount of agglomerate precipitated was 3 mg, which is no problem for practical use. On the other hand, Comparative Examples 5 and 6 which fail to satisfy the relation A<B are problematical in amount of agglomerate and image quality. Generally similar good results were obtained when the test of Example 8 was carried out using NBR instead of PTFE as a material of the diaphragm.

Examples 10 to 12 and Comparative Examples 7 and 8

Preparation of Heat Developable Photosensitive Material

A heat developable photosensitive material was prepared in accordance with the method of JP 2004-246143A.

(a) Preparation of PET Substrate (a-1) Film Formation

Polyethylene terephthalate (PET) having an intrinsic viscosity of 0.66 (measured in phenol/tetrachloroethane=6/4 by mass at 25° C.) was prepared using terephthalic acid and ethylene glycol in a usual manner, pelletized, and dried at 130° C. for 4 hours. The PET pellets were melted at 300° C., extruded from a T die, and rapidly chilled to obtain an unstretched film with such a thickness that would be 175 μm after heat set.

The film was stretched longitudinally 3.3 times at 110° C. using pairs of rolls having different peripheral speeds and then laterally 4.5 times at 130° C. using a tenter frame. The film was heat set at 240° C. for 20 seconds and then relaxed 4% of its width at the same temperature. The film edges that had been gripped by the tenter clips were trimmed from the main film body. The film was knurled along its both edges and taken up at a speed of 4 kg/cm$^2$ into roll form. The film thickness was 175 μm.

(a-2) Corona Discharge Treatment

The film was treated on both sides in a solid state corona discharger (6KVA, from Pillar) at room temperature at a rate of 20 m/min. It was found from the current and voltage readings during the treatment that the film was treated at 0.375 kV·A·min/m$^2$. The treating frequency was 9.6 kHz, and the clearance between the electrode and the dielectric roll was 1.6 mm. There was thus obtained a 175 μm-thick biaxially stretched PET substrate.

(b) Undercoating Layer Formation

| Formulation 1 (for undercoating layer on the photosensitive layer side) | |
|---|---|
| Polyether sulfone resin (A-520, from Takamatsu Oil & Fat Co., Ltd.; 30% solution) | 59 g |
| Polyethylene glycol monononyl phenyl ether (average mole number of ethylene oxide added = 8.5; 10% solution) | 5.4 g |

-continued

| Formulation 1 (for undercoating layer on the photosensitive layer side) | |
|---|---|
| Polymer particles (MP-1000, from Soken Chemical & Engineering Co., Ltd.; average particle size: 0.4 μm) | 0.91 g |
| Distilled water | 937 ml |

| Formulation 2 (for 1st undercoating layer on the reverse side) | |
|---|---|
| Styrene-butadiene copolymer latex (solid content: 40%; styrene/butadiene = 68/32) | 158 g |
| 2,4-Dichloro-6-hydroxy-s-triazine sodium salt (8% aqueous solution) | 20 g |
| 1% Aqueous solution of sodium laurylbenzenesulfonate | 10 ml |
| Distilled water | 854 ml |

| Formulation 3 (for 2nd undercoating layer on the reverse side) | |
|---|---|
| $SnO_2$/SbO (9/1; average particle size: 0.038 μm; 17% dispersion) | 84 g |
| Gelatin (10% aqueous solution) | 89.2 g |
| Water soluble cellulose ether (Metolose C-5, from Shin-Etsu Chemical Co., Ltd.; 2% aqueous solution) | 8.6 g |
| Polymer particles (MP-1000, from Soken Chemical & Engineering Co., Ltd.) | 0.01 g |
| 1% Aqueous solution of sodium dodecylbenzenesulfonate | 10 ml |
| NaOH (1% solution) | 6 ml |
| Proxel (from ICI) | 1 ml |
| Distilled water | 805 ml |

The coating composition of formulation 1 was applied to one side of the PET substrate having been treated on both sides by a corona discharge (the side on which a photosensitive layer was to be provided) with a wire bar to a wet coating thickness of 6.6 ml/m$^2$ and dried at 180° C. for 5 minutes. The coating composition of formulation 2 was applied to the opposite side (back side) of the substrate with a wire bar to a wet thickness of 5.7 ml/m$^2$ and dried at 180° C. for 5 minutes to form a first undercoating layer. The coating composition of formulation 3 was applied on the first undercoating layer with a wire bar to a wet thickness of 7.7 ml/m$^2$ and dried at 180° C. for 6 minutes.

(c) Backcoating Layer Formation (c-1) Preparation of Coating Compositions for Backcoating Layers (c-1-1) Preparation of Base Precursor Dispersion Base precursor compound 1 (2.5 kg), 300 g of a surfactant (Demol N, from Kao Corp.), 800 g of diphenylsulfone, 1.0 g of sodium benzisothiazolinone, and distilled water (the balance) were mixed to make 8.0 kg. The mixture was delivered by a diaphragm pump to a horizontal sand mill (UVM-2, from IMEX Co., Ltd.) containing zirconia beads (average diameter: 0.5 mm) under an inner pressure of at least 50 hPa until a desired average particle size was obtained. The dispersing operation was continued until the ratio of absorbance at 450 nm to absorbance at 650 nm (D450/D650) of the dispersion reached 3.0 as measured by spectrophotometry. The resulting dispersion was diluted with distilled water to a base precursor concentration of 25%, followed by filtration through a polypropylene filter (average pore size: 3 μm) to be freed of dust.

(c-1-2) Preparation of Dye Dispersion

Cyanine dye compound 1 (6.0 kg), 3.0 kg of sodium p-dodecylbenzenesulfonate, 0.6 kg of a surfactant (Demol SNB, from Kao Corp.), and 0.15 kg of a defoaming agent (Surfinol 104E, from Nisshin Chemical Industry Co., Ltd.), and distilled water were mixed to make 60 kg. The mixture was dispersed in a horizontal sand mill (UVM-2, from IMEX Co., Ltd.) containing zirconia beads (average diameter: 0.5 mm). The dispersing operation was continued until the ratio of absorbance at 650 nm to absorbance at 750 nm (D650/D750) of the dispersion reached or exceeded 5.0 as measured by spectrophotometry. The resulting dispersion was diluted with distilled water to a cyanine dye concentration of 6%, followed by filtration through a polypropylene filter (average pore size: 1 μm) to be freed of dust.

(c-1-3) Preparation of Coating Composition for Antihalation Layer

In a container kept at 40° C. were put 40 g of gelatin, 20 g of mono-dispersed polymethyl methacrylate particles (average particle size: 8 μm; particle size standard deviation: 0.4), 0.1 g of benzisothiazolinone, and 490 ml of water to dissolve the gelatin. To the container were further put 2.3 ml of a 1 mol/l aqueous solution of sodium hydroxide, 40 g of the dye dispersion prepared in (c-1-2), 90 g of the base precursor dispersion prepared in (c-1-1), 12 ml of a 3% aqueous solution of sodium polystyrenesulfonate, and 180 g of a 10% SBR latex and mixed. Immediate before application, 80 ml of a 4% aqueous solution of N,N-ethylenebis(vinylsulfonacetamide) was mixed therein to prepare a coating composition for antihalation layer.

(c-1-4) Preparation of Coating Composition for Back Side Protective Layer

In a container maintained at 40° C. were put 40 g of gelatin, 35 mg of benzisothiazolinone, and 840 ml of water to dissolve the gelatin. The solution was mixed with 5.8 ml of a mol/l aqueous solution of sodium hydroxide, 1.5 g of liquid paraffin in emulsified form, 10 ml of a 5% aqueous solution of sodium di(2-ethylhexyl) sulfosuccinate, 20 ml of a 3% aqueous solution of sodium polystyrenesulfonate, 2.4 ml of a 2% solution of fluorine surfactant F-1, 2.4 ml of a 2% solution of fluorine surfactant F-2, and 32 g of a 19% latex of a methylmethacrylate/styrene/butyl acrylate/hydroxyethyl methacrylate/acrylic acid copolymer (=57/8/28/5/2). Immediately before application, 25 ml of a 4% aqueous solution of N,N-ethylenebis(vinylsulfonacetamide) was mixed therein to prepare a coating composition for back side protective layer.

(c-2) Formation of Backcoating Layers

The coating composition for antihalation layer and the coating composition for back side protective layer were simultaneously applied to the back side of the substrate and dried to form an antihalation layer having a gelatin content of 0.52 g/m$^2$ and a back side protective layer having a gelatin content of 1.7 g/m$^2$.

(d) Image Forming Layer, Intermediate Layer, and Surface Protective Layer (1) Preparation of Silver Halide Emulsion 1

In 1421 ml of distilled water was added 3.1 ml of a 1% potassium bromide solution. To the solution were added 3.5 ml of a 0.5 mol/l sulfuric acid aqueous solution and 31.7 g of gelatin phthalide were added. The solution was maintained at 30° C. in a stainless steel reaction vessel while stirring, and solution A prepared by diluting 22.22 g of silver nitrate with distilled water to make 95.4 ml and solution B prepared by diluting 15.3 g of potassium bromide and 0.8 g of potassium iodide with distill water to make 97.4 ml were added thereto at the respective constant rates over a period of 45 seconds. To the system were added 10 ml of a 3.5% hydrogen peroxide aqueous solution and then 10.8 ml of a 10% benzimidazole aqueous solution. Solution C prepared by diluting 51.86 g of silver nitrate with distilled water to make 317.5 ml and solution D prepared by diluting 44.2 g of potassium bromide and 2.2 g of potassium iodide with distilled water to make 400 ml were added thereto by a controlled double jet method in which solution C was added at a constant rate over 20 minutes, and solution D was added while maintaining the pAg at 8.1. After 10 minutes from the start of adding solutions C and D, potassium hexachloroiridate (III) was added to the system in an amount of $1\times10^{-4}$ mol per mole of silver. After 5 seconds from the completion of addition of solution C, $3\times10^{-4}$ mol, per mole of silver, of potassium hexacyanoferrate (II) aqueous solution was added. After the system was adjusted to a pH of 3.8 with a 0.5 mol/l sulfuric acid aqueous solution, the stirring was stopped, followed by sedimentation, desalting, and washing with water. Finally, the pH was adjusted to 5.9 with a 1 mol/l sodium hydroxide aqueous solution to give a silver halide dispersion having a pAg of 8.0.

While stirring the silver halide dispersion at 38° C., 5 ml of a 0.34% solution of 1,2-benzisothiazolin-3-one in methanol was added thereto. Forty minutes later, the temperature was raised to 47° C. Twenty minutes after the temperature elevation, $7.6\times10^{-5}$ mol, per mole of silver, of sodium benzenethiosulfonate was added as a methanol solution. Five minutes later, $2.9\times10^{-4}$ mol, per mole of silver, of tellurium sensitizer C was added as a methanol solution, followed by ripening for 91 minutes. A methanol solution containing spectral sensitizing dyes A and B in a molar ratio of 3:1 was added to the system to give a total content of dyes A and B of $1.2\times10^{-3}$ mol per mole of silver. One minute later, 1.3 ml of a 0.8% solution of N,N'-dihydroxy-N",N"-diethylmelamine in methanol was added thereto. Four minutes later, $4.8\times10^{-3}$ mol, per mole of silver, of 5-methyl-2-mercaptobenzimidazole in methanol, $5.4\times10^{-3}$ mol, per mole of silver, of 1-phenyl-2-heptyl-5-mercapto-1,3,4-triazole in methanol, and $8.5\times10^{-3}$ mol, per mole of silver, of 1-(3-methylureidopheny71)-5-mercaptotetrazole in water were added thereto to prepare silver halide emulsion 1.

The resulting silver halide emulsion contained silver iodobromide grains having an average sphere equivalent diameter of 0.042 μm with a coefficient of sphere equivalent diameter variation of 20% and uniformly containing 3.5 mol % of iodide. The averages of the particle size and the like were determined by measuring 1000 particles under an electron microscope. The ratio of the [100] plane was found to be 80% using Kubelka-Munk theory.

(2) Preparation of Silver Halide Emulsion 2

A silver halide emulsion was prepared in the same manner as in the preparation of silver halide emulsion 1 with the following exceptions. The solution temperature at the time of grain formation was changed from 30° C. to 47° C. Solution B was prepared by diluting 15.9 g of potassium bromide with distilled water to make 97.4 ml. Solution D was prepared by diluting 45.8 g of potassium bromide with distilled water to make 400 ml. Solution C was added over a period of 30 minutes. Potassium hexacyanoferrate (II) was not added. The dispersion was subjected to sedimentation, followed by desalting, followed by washing with water, followed by dispersing in the same manner as for the preparation of silver halide emulsion 1. The emulsion was spectrally and chemically sensitized in the same manner as for the preparation of emulsion 1, except that the amount of the tellurium sensitizer C was changed to $1.1\times10^{-4}$ mol/mol-Ag, the total amount of spectral sensitizing dyes A and B (=3:1 by mole, both as a methanol solution) was changed to $7.0\times10^{-4}$ mol/mol-Ag, and the amount of 1-phenyl-2-heptyl-5-mercapto-1,3,4-triazole was changed to $3.3\times10^{-3}$ mol/mol-Ag. Furthermore, the amount of 1-(3-methylureidophenyl)-5-mercaptotetrazole was changed to $4.7\times10^{-3}$ mol/mol-Ag. The resulting silver halide emulsion 2 contained cubic pure silver bromide grains having an average sphere equivalent diameter of 0.080 μm with a variation coefficient of 20%.

(3) Preparation of Silver Halide Emulsion 3

Silver halide emulsion 3 was prepared in the same manner as for the silver halide emulsion 1, except that the solution temperature at the time of grain formation was changed from 30° C. to 27° C. After sedimentation, desalting, washing, and dispersing, the emulsion was further processed in the same manner as for the preparation of emulsion 1, except that spectral sensitizing dyes A and B were added in a molar ratio of 1:1 both in the form of a dispersion in an aqueous gelatin solution in a total amount of $6\times10^{-3}$ mol/mol-Ag, the amount of tellurium sensitizer C was changed to $5.2\times10^{-4}$ mol/mol-Ag, and, after 3 minutes from the addition of the tellurium sensitizer, $5\times10^{-4}$ mol/mol-Ag of bromoauric acid and $2\times10^{-3}$ mol/mol-Ag of potassium thiocyanate were added to the system. The resulting silver halide emulsion 3 contained silver iodobromide grains having an average sphere equivalent diameter of 0.034 μm with a variation coefficient of 20% and uniformly containing 3.5 mol % of iodine.

(4) Preparation of Mixed Emulsion A for Coating

Silver halide emulsions 1, 2 and 3 prepared above were mixed in a ratio of 70:15:15, and a 1% aqueous solution of benzothiazolium iodide was added to the mixture in an amount of $7\times10^{-3}$ mol/mol-Ag. Water was added thereto to result in a silver halide content of 38.2 g in term of silver per kg of the mixed emulsion. To the mixed emulsion was added 0.34 g of 1-(3-methylureidophenyl)-5-mercaptotetrazole per kg of the mixed emulsion. Finally, compound Nos. 1, 20, and 26 disclosed in JP 2004-246143A were added to the mixed emulsion each in an amount of $2\times10^{-3}$ mol/mol-Ag. These compounds are of the type the one-electron-oxidization product of which is still capable of releasing one or more electrons.

(5) Preparation of Fatty Acid Silver Salt Dispersion A

Behenic acid (Edenor C22-85R, from Henkel Co.) (87.6 kg), 423 L of distilled water, 49.2 L of a 5 mol/l aqueous solution of sodium hydroxide, and 120 L of tert-butanol were mixed and stirred for one hour at 75° C. to prepare sodium behenate solution A. Separately, 206.2 L of an aqueous solution (pH 4.0) containing 40.4 kg of silver nitrate was prepared and maintained at 10° C. In a reaction vessel, 635 L of distilled water and 30 L of tert-butanol were placed and maintained at 30° C., and the whole amount of the sodium behenate solution A and the whole amount of the silver nitrate aqueous solution prepared above were added thereto while thoroughly stirring at respective constant rates over a period of 93 minutes and 15 seconds and a period of 90 minutes, respectively, in the following fashion. Addition of the silver nitrate aqueous solution was started first. At the time when the addition of the silver nitrate aqueous solution lasted for 11 minutes, addition of sodium behenate solution A was started. After the addition of the silver nitrate aqueous solution completed, the addition of sodium behenate solution A was continued for an additional period of 14 minutes and 15 seconds. During the addition, the temperature inside the reaction vessel was maintained at 30° C. by controlling externally so that the mixed solution temperature was kept constant. The sodium behenate solution A was fed through a hot water jacketed pipe so that the temperature of solution A might be 75° C. at the tip of the nozzle, while the silver nitrate aqueous solution was fed through a cold water jacketed pipe. The position of adding the sodium behenate solution A and that of the silver nitrate solution were symmetric about the stirring axis and above the liquid level so as to be kept away from the reaction solution.

After completion of the addition of solution A, the reaction system was kept at the same temperature for 20 minutes while stirring and then heated up to 35° C. over 30 minutes, at which temperature the system was ripened for 210 minutes. Immediately thereafter, the solid matter was collected by centrifugal filtration and washed with water until the conductivity of the washing was 30 μS/cm to give a fatty acid silver salt in wet cake form. The wet cake was preserved as such.

The form of the thus produced silver behenate grains was observed by electron micrography. As a result, the grains were found to be scaly crystals with, on average, a=0.14 μm, b=0.4 μm, and c=0.6 μm, an average aspect ratio of 5.2, an average sphere equivalent diameter of 0.52 μm, and a coefficient of variation of 15% with respect to the sphere equivalent diameter (wherein a, b and c are as defined in the invention).

To the wet cake weighing 260 kg on dry basis, 19.3 kg of polyvinyl alcohol (PVA-217, from Kuraray Co. Ltd.) and water were added to make 1,000 kg. The mixture was slurried with a dissolver blade and then preliminary dispersed in a pipe line mixer (Model PM-10, from Mizuho Industrial Co., Ltd.).

The resulting dispersion was further dispersed in three passes on a dispersing machine Microfluidizer M-610 (from Microfluidex International Corp.) having a Z-type interaction chamber under a pressure adjusted at 1260 kg/cm$^2$ to give a silver behenate dispersion. During the dispersing operation, the temperature of the dispersion was set at 18° C. by circulating a coolant of controlled temperature in a coiled heat exchanger provided at the inlet and the outlet of the interaction chamber.

(6) Preparation of Fatty Acid Silver Salt Dispersion B

Behenic acid (Edenor C22-85R, from Henkel Japan Co., Ltd.) (100 kg) was dissolved in 1200 kg of isopropyl alcohol at 50° C. The solution was filtered through a filter having a pore size of 10 μm, and the filtrate was cooled at a rate of 3° C./hr to recrystallize. The resulting crystals were collected by centrifugal filtration, washed on the filter with 100 kg of isopropyl alcohol, and dried. The crystals thus obtained were esterified and analyzed by GC-FID. As a result, the crystals were found to have a behenic acid content of 96 mol %, a lignoceric acid content of 2 mol %, an arachidic acid content of 2 mol %, and an erucic acid content of 0.001 mol %.

The recrystallized behenic acid prepared above (88 kg), 422 L of distilled water, 49.2 L of a 5 mole/l aqueous solution of sodium hydroxide, and 120 L of tert-butyl alcohol were mixed. The mixture was allowed to react by stirring at 75° C. for 1 hour to obtain sodium behenate solution B. Separately, 206.2 L of an aqueous solution (pH 4.0) of 40.4 kg of silver nitrate was prepared and kept at 10° C. In a reaction vessel, 635 L of distilled water and 30 L of tert-butanol were placed and maintained at 30° C., and the whole amount of the sodium behenate solution B and the whole amount of the silver nitrate aqueous solution prepared above were added thereto while thoroughly stirring at respective constant rates over a period of 93 minutes and 15 seconds and a period of 90 minutes, respectively, in the following fashion. Addition of the silver nitrate aqueous solution was started first. At the time when the addition of the silver nitrate aqueous solution lasted for 11 minutes, addition of sodium behenate solution B was started.

After the addition of the silver nitrate aqueous solution completed, the addition of sodium behenate solution B was continued for an additional period of 14 minutes and 15 seconds. During the addition, the temperature inside the reaction vessel was maintained at 30° C. by controlling externally so that the mixed solution temperature was kept constant. The sodium behenate solution B was fed through a hot water jacketed pipe so that the temperature of solution B might be 75° C. at the tip of the nozzle, while the silver nitrate aqueous solution was fed through a cold water jacketed pipe. The position of adding sodium behenate solution B and that of silver nitrate aqueous solution were symmetric about the stirring axis and above the liquid level so as to be kept away from the reaction solution.

After completion of the addition of sodium behenate solution B, the reaction system was kept at the same temperature for 20 minutes while stirring and then heated up to 35° C. over 30 minutes, at which temperature the system was ripened for 210 minutes. Immediately thereafter, the solid matter was collected by centrifugal filtration and washed with water until the conductivity of the washing was 30 μS/cm to give a fatty acid silver salt. The resulting wet cake was preserved as such.

The form of the thus produced silver behenate grains was observed by electron micrography. As a result, the grains were found to have, on average, a=0.21 μm, b=0.4 μm, and c=0.4 μm, an average aspect ratio of 2.1, an average sphere equivalent diameter of μm, and a coefficient of variation of 11% with respect to the sphere equivalent diameter (wherein a, b and c are as defined in the invention).

To the wet cake weighing 260 kg on dry basis, 19.3 kg of polyvinyl alcohol (PVA-217, from Kuraray Co. Ltd.) and water were added to make 1,000 kg. The mixture was slurried with a dissolver blade and then preliminary dispersed in a pipe line mixer (Model PM-10, from Mizuho Industrial Co., Ltd.).

The resulting dispersion was further dispersed in three passes on a dispersing machine Microfluidizer M-610 (from Microfluidex International Corp.) having a Z-type interaction chamber under a pressure adjusted to 1150 kg/cm$^2$ to give silver behenate dispersion B. During the dispersing operation, the temperature of the dispersion was set at 18° C. by circulating a coolant of controlled temperature in a coiled heat exchanger provided in the inlet and the outlet of the interaction chamber.

(7) Preparation of Reducing Agent Dispersion

Reducing agent S-1 shown below (10 kg), 16 kg of a 10% aqueous solution of a modified polyvinyl alcohol (Poval MP203, from Kuraray Co., Ltd.), and 10 kg of water were mixed well to make a slurry. The slurry was delivered by a diaphragm pump to a horizontal sand mill (UVM-2, from AIMEX Co., Ltd.) filled with zirconia beads having an average diameter of 0.5 mm, where it was dispersed for, as a rough standard, 3 hours. The dispersing time was adjusted so as to reduce the particle size to a median diameter of 0.40 μm. To the dispersion were added 0.2 g of sodium benzisothiazolinone and water to adjust the reducing agent concentration to 25%. The dispersion was then heat treated at 60° C. for 5 hours to give a reducing agent dispersion. The reducing agent particles in the dispersion had a median diameter of 0.40 μm and a maximum particle diameter of 1.4 μm or smaller. The resulting reducing agent dispersion was stored after it was filtered through a polypropylene filter having a pore size of 3.0 μm to remove any foreign matter, such as dust.

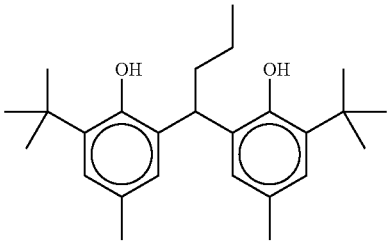

(8) Preparation of Dispersion of Hydrogen Bond-Forming Compound-1

Tri(4-tert-butylphenyl)phosphine oxide (10 kg) as a hydrogen bond-forming compound-1, 16 kg of a 10% aqueous solution of a modified polyvinyl alcohol (Poval MP-203, from Kuraray Co., Ltd.), and 10 kg of water were thoroughly mixed to make a slurry. The slurry was delivered by a diaphragm pump to a horizontal sand mill (UVM-2, from AIMEX Co., Ltd.) filled with zirconia beads having an average diameter of 0.5 mm, where it was dispersed for 4 hours. To the dispersion were added 0.2 g of sodium benzisothiazolinone and water to result in a hydrogen bond-forming compound concentration of 25%. The dispersion was heated at 40° C. for 1 hour and then at 80° C. for 1 hour to prepare a dispersion of hydrogen bond-forming compound-1. The hydrogen bond-forming compound-1 particles in the dispersion had a median diameter of 0.45 μm and a maximum diameter of 1.3 μm or less. The dispersion was stored after it was filtered through a polypropylene filter having a pore size of 3.0 μm to be freed of any foreign matter including dust.

(9) Preparation of Development Accelerator Dispersion

A development accelerator shown below (10 kg), 20 kg of a 10% aqueous solution of a modified polyvinyl alcohol (Poval MP-203, from Kuraray Co., Ltd.), and 10 kg of water were mixed and thoroughly stirred to make a slurry. The slurry was delivered by a diaphragm pump to a horizontal sand mill (UVM-2, from AIMEX Co., Ltd.) filled with zirconia beads having an average diameter of 0.5 mm for, as a rough standard, 3.5 hours. The dispersing time was adjusted so as to reduce the particle size to a median diameter of 0.48 μm. To the dispersion were added 0.2 g of sodium benzisothiazolinone and water to adjust the development accelerator concentration to 20%. The development accelerator particles in the resulting dispersion had a median diameter of 0.30 to 0.60 μm and a maximum particle diameter of 1.5 μm or smaller. The dispersion was stored after it was filtered through a polypropylene filter having a pore size of 3.0 μm to be freed of any foreign matter, such as dust.

Development Accelerator:

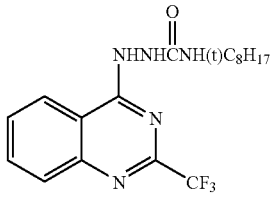

(10) Preparation of Polyhalogen Compound Dispersion (10-1) Preparation of Organic Polyhalogen Compound-1 Dispersion Ten kilograms of tribromomethanesulfonylbenzene as an organic polyhalogen compound-1, 10 kg of a 20% aqueous solution of a modified polyvinyl alcohol (Poval MP-203, form Kuraray Co., Ltd.), 0.4 kg of a 20% aqueous solution of sodium triisopropylnaphthalenesulfonate, and 14 kg of water were thoroughly mixed together to prepare a slurry. The slurry was delivered by a diaphragm pump to a horizontal sand mill (UVM-2, from AIMEX Co., Ltd.) filled with zirconia beads having an average diameter of 0.5 mm, where it was dispersed for 5 hours. To the dispersion were added 0.2 g of a sodium salt of benzisothiazolinone and water to make a dispersion containing organic polyhalogen compound-1 in a concentration of 26%. The organic polyhalogen compound-1 particles present in the thus prepared dispersion had a median diameter of 0.41 μm and a maximum diameter of 2.0 μm or below. The dispersion was stored after it was filtered through a polypropylene filter having a pore size of 10.0 μm to remove any foreign matter including dust.

(10-2) Preparation of Organic Polyhalogen Compound-2 Dispersion

Ten kilograms of N-butyl-3-tribromomethanesulfonylbenzamide as an organic polyhalogen compound-2, 20 kg of a 10% aqueous solution of a modified polyvinyl alcohol (Poval MP-203, form Kuraray Co., Ltd.), and 0.4 kg of a 20% aqueous solution of sodium triisopropylnaphthalenesulfonate were thoroughly mixed together to prepare a slurry. The slurry was delivered by a diaphragm pump to a horizontal sand mill (UVM-2, from AIMEX Co., Ltd.) filled with zirconia beads having an average diameter of 0.5 mm, where it was dispersed for 5 hours. To the dispersion were added 0.2 g of a sodium salt of benzisothiazolinone and water to adjust the organic polyhalogen compound concentration to 30%. The dispersion was heated at 40° C. for 5 hours to obtain a dispersion of organic polyhalogen compound-2. The organic polyhalogen compound-1 particles present in the resulting dispersion had a median diameter of 0.40 μm and a maximum diameter of 1.3 μm or below. The dispersion was stored after it was filtered through a polypropylene filter having a pore size of 3.0 μm to remove any foreign matter including dust.

(11) Preparation of Phthalazine Compound-1 Solution

In 174.57 kg of water was dissolved 8 kg of a modified polyvinyl alcohol (Poval MP 203, from Kuraray Co., Ltd.). To the solution were added 3.15 kg of a 20% aqueous solution of sodium triisopropylnaphthalenesulfonate and 14.28 kg of a 70% aqueous solution of 6-isopropylphthalazine as phthalazine compound-1 to prepare a 5% phthalazine compound-1 solution.

(12) Preparation of Mercapto Compound Solution (12-1) Preparation of Mercapto Compound-1 Aqueous Solution In 993 g of water was dissolved 7 g of sodium salt of 1-(3-sulfophenyl)-5-mercaptotetrazole as mercapto compound-1 to prepare a 0.7% aqueous solution.

(12-2) Preparation of Mercapto Compound-2 Aqueous Solution

In 980 g of water was dissolved 20 g of 1-(3-methylureido)-5-mercaptotetrazole as mercapto compound-2 to prepare a 2.0% aqueous solution.

(13) Preparation of Pigment Dispersion

C.I. Pigment Blue 60 (64 g), 6.4 g of a surfactant (Demol N, from Kao Corp.), and 250 g of water were mixed well to make a slurry. The slurry was dispersed together with 800 g of zirconia beads having an average diameter of 0.5 mm in a dispersing machine (¼ G sand grinder mill, from AIMEX Co., Ltd.) for 25 hours. Water was added to obtain a pigment dispersion with a pigment concentration of 5%. The pigment particles in the pigment dispersion had an average particle size of 0.21 μm.

(14) Preparation of SBR Latex

A polymerization vessel of a gas monomer reaction apparatus (TAS-2J, from Taiatsu Techno Corp.) was charged with 287 g of distilled water, 7.73 g of a surfactant (Pionin A-43-S, from Takemoto Oil & Fat Co., Ltd., solid content: 48.5%), 14.06 ml of 1 mole/l aqueous solution of sodium hydroxide, 0.15 g of tetrasodium ethylenediaminetetraacetate, 255 g of styrene, 11.25 g of acrylic acid, and 3.0 g of tert-dodecyl mercaptan. The vessel was sealed, and the mixture was stirred at 200 rpm. The mixture was deaerated using a vacuum pump and purged with nitrogen gas a few times. Thereafter, 108.75 g of 1,3-butadiene was added under pressure, and the inner temperature was raised to 60° C. Then, a solution of 1.875 g of ammonium persulfate in 50 ml of water was added, followed by stirring for 5 hours. The temperature was further raised to 90° C., at which the stirring was continued for an additional 3 hour period. After completion of the reaction, the inner temperature was dropped to room temperature, and a 1 mole/l NaOH and $NH_4OH$ were added to the reaction mixture so as to result in an $Na^+$ ion to $NH^{4+}$ ion molar ratio of 1:5.3, whereby the pH was adjusted to 8.4. The resulting reaction mixture was stored after it was filtered by a polypropylene filter having a pore size of 1.0 μm to remove any foreign matter, such as dust. There was thus obtained 774.7 g of an SBR latex. As a result of measuring a halogen ion by ion chromatography, the chloride ion concentration was 3 ppm. As a result of high performance liquid chromatography, the concentration of the chelating agent was found to be 145 ppm.

The SBR latex prepared had an average particle size of 90 nm, a Tg of 17° C., a solid content of 44%, an equilibrium water content of 0.6% at 25° C. and 60% RH, and an ion conductivity of 4.80 mS/cm (as measured on the latex as obtained at 25° C. using a conductivity analyzer CM-30S, from DKK-TOA Corp.).

(15) Preparation of Coating Compositions (15-1) Preparation of Coating Composition for Image Forming Layer The fatty acid silver salt dispersion A (1000 g), 135 ml of water, 35 g of the pigment dispersion 1, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.), the reducing agent S-1 dispersion (the amount was in accordance with the composition of image forming layer described later), 106 g of the hydrogen bond-forming compound-1 dispersion, the development accelerator dispersion (the amount was in accordance with the composition of image forming layer described later), 9 ml of the mercapto compound-1 aqueous solution, and 27 ml of the mercapto compound-2 aqueous solution were successively mixed. Immediately before application, 118 g of the silver halide mixed emulsion A was added, followed by mixing thoroughly. The coating composition for image forming layer thus prepared was fed to a coating die and applied after it had been circulated through each of the diaphragm pumps described above for 24 hours.

The viscosity of the coating composition was 27 mPa·s at 40° as measured with a Brookfield viscometer (from Tokyo Keiki Kogyo) equipped with No. 1 rotor (60 rpm). When measured using a rheometer (RheoStress RS150, from at 38° C. under shear rates of 0.1, 1, 10, 100 and 1000 $sec^{-1}$, the viscosity of the coating composition was 31, 35, 31, 26, and 17 mPa·s, respectively. The zirconium content in the coating composition was 0.30 mg per gram of silver.

(15-2) Preparation of Coating Composition for Intermediate Layer

A thousand grams of polyvinyl alcohol (PVA-205, from Kuraray Co., Ltd.), 163 g of the pigment dispersion, 33 g of an aqueous solution of a blue dye compound (Kayafect Turquoise RN Liquid 150, from Nippon Kayaku Co., Ltd.), 27 ml of a 5% aqueous solution of sodium di(2-ethylhexyl)sulfosuccinate, and 4200 ml of a 19% latex of a methyl methacrylate/styrene/butyl acrylate/hydroxyethyl methacrylate/acrylic acid copolymer (57/8/28/5/2) were mixed. To the mixture were added 27 ml of a 5% aqueous solution of aerosol OT (from American Cyanamid Co.), 135 ml of a 20% aqueous solution of diammonium phthalate, and water to give a total weight of 10000 g. The mixture was adjusted with NaOH to give a pH of 7.5 to provide a coating solution for intermediate layer, which was fed to a coating die at a rate of 8.9 ml/m$^2$. The viscosity of the coating composition was 58 mPa·s at 40° C. measured with a Brookfield viscometer equipped with a No. 1 rotor (60 rpm).

(15-3) Preparation of Coating Composition for 1St Protective Layer

Inert gelatin (100 g) and 10 mg of benzisothiazolinone were dissolved in 840 ml of water. To the solution were added 180 g of a 19% latex of methyl methacrylate/styrene/butyl acrylate/hydroxyethyl methacrylate/acrylic acid copolymer (57/8/28/5/2), 69 ml of a 15% methanol solution of phthalic acid, and 5.4 ml of a 5% aqueous solution of sodium di(2-ethylhexyl)sulfosuccinate. Immediately before application, 40 ml of 4% alum was mixed into the coating composition using a static mixer. The coating composition was delivered to a coating die at a rate of 26.1 ml/m$^2$. The viscosity of the coating composition was 20 mPa·s at 40° C. measured with a Brookfield viscometer equipped with a No. 1 rotor (60 rpm).

(15-4) Preparation of Coating Composition for 2nd Protective Layer

Inert gelatin (100 g) and 10 mg of benzisothiazolinone were dissolved in 800 ml of water. To the solution were added 8.0 g of liquid paraffin in emulsified form, 180 g of a 19% latex of methyl methacrylate/styrene/butyl acrylate/hydroxyethyl methacrylate/acrylic acid copolymer (57/8/28/5/2), 40 ml of a 15% methanol solution of phthalic acid, 5.5 ml of a 1% aqueous solution of a fluorine surfactant (F-1), 5.5 ml of a 1% aqueous solution of a fluorine surfactant (F-2), 28 ml of a 5% aqueous solution of sodium di(2-ethylhexyl)sulfosuccinate, 4 g of polymethyl methacrylate particles having an average particle size of 0.7 μm, and 21 g of polymethyl methacrylate particles having an average particle size of 4.5 μm to prepare a coating composition for 2nd protective layer, which was delivered to a coating die at a rate of 8.3 ml/m$^2$. The viscosity of the coating composition was 19 mPa·s at 40° C. measured with a Brookfield viscometer equipped with a No. 1 rotor (60 rpm).

(e) Preparation of Heat Developable Photosensitive Material

The coating compositions for image forming layer, intermediate layer, 1st protective layer, and 2nd protective layer were simultaneously applied to the undercoating layer on the photosensitive layer side of the PET substrate in layer relationship in the order described from the side of the undercoating layer by a slide bead coating method to make a heat developable photosensitive material. During the application, the temperature of the coating compositions for image forming layer and intermediate layer was maintained at 31° C., that for 1st protective layer was 36° C., and that for 2nd protective layer was 37° C.

The composition (unit: g/m$^2$) of the thus formed image forming layer was as follows.

| | |
|---|---|
| Silver behenate | 5.42 |
| Pigment (C.I. Pigment Blue 60) | 0.036 |
| Polyhalogen compound-1 | 0.12 |
| Polyhalogen compound-2 | 0.25 |
| Phthalazine compound-1 | 0.18 |
| SBR latex (Tg: 17° C.) | 9.70 |
| Reducing agent S-1 | 0.77 |
| Hydrogen bond-forming compound-1 | 0.58 |
| Development accelerator | 0.04 |
| Mercapto compound-1 | 0.002 |
| Mercapto compound-2 | 0.012 |
| Silver halide | 0.10 (in terms of Ag) |

The coating and drying conditions were as follows. The substrate was destaticized by ion blowing before being coated. The coating speed was 160 m/min. The gap between the tip of the coating die and the substrate was from 0.10 to 0.30 mm. The pressure in the vacuum chamber was set at 196 to 882 Pa lower than the atmospheric pressure. As stated above, the coating composition for image forming layer was applied after being circulated in each of the diaphragm pumps shown in Table 4 for 24 hours.

In the next chilling zone, the coatings were chilled by blowing air having a dry-bulb temperature of 10° to 20° C. The coated web was conveyed in a non-contact state into a contactless, helical dryer, where it was dried with dry air having a dry-bulb temperature of 23° to 45° C. and a wet-bulb temperature of 15° to 21° C. After drying, the coated web was conditioned at 25° C. and 40 to 60% RH and then heated such that the web surface temperature reached 70 to 90° C., followed by cooling to drop the web surface temperature to 25° C.

(f) Image Formation and Evaluation

The resulting coated web was cut into heat developable photosensitive sheets measuring 356 mm by 432 mm. Each cut sheet was packaged in a packaging material described below in an environment of 25° C. and 50% RH, and stored at room temperature for 2 weeks. The packaging material was a laminate composed of a 10 μm thick PET layer, a 12 μm thick PE layer, 9 μm thick aluminum foil, a 15 μm thick Ny layer, and a 50 μm thick layer of polyethylene containing 3% carbon and having an oxygen permeability of 0.02 ml/atm·m$^2$/day at 25° C. and a moisture permeability of 0.10 g/atm·m$^2$/day at 25° C.

The heat-developable photosensitive sheet was entirely exposed to give a density of 1.2, then imagewise exposed using a dry laser imager (DRyPIX 7000 equipped with a 660 nm semiconductor laser having a maximum output of 50 mW (IIIB)), and heat developed using three panels set at 107° C., 121° C., and 121° C., respectively, for a total heat development time of 14 seconds. Thirty sheets were tested per sample.

A panel of 5 members observed the thus formed images with the naked eye through a transmissive viewer for medical use and scored the image quality in terms of density evenness according to the following system. Samples scored 4 or higher are acceptable. The results are shown in Table 4.

5: Density unevenness is observed in none of the 30 sheets.
4: Slight density unevenness is observed in 1 to 4 sheets.
3: Slight density unevenness is observed in 5 to 8 sheets.
2: Slight density unevenness is observed in 9 to 12 sheets.
1: Slight density unevenness is observed in more than 12 sheets.

TABLE 4

| | A (mm) | B (mm) | A < B | C (mm) | C < A | Amount of Agglomerate | Image Quality |
|---|---|---|---|---|---|---|---|
| Comp. Example 7 | — | 9.7 | — | — | — | 48 | 2 |
| Comp. Example 8 | 15.2 | 9.7 | no | — | — | 45 | 2 |
| Example 10 | 8.5 | 9.7 | yes | — | — | 3 | 4 |
| Example 11 | 9.2 | 9.7 | yes | 6 | yes | 2 | 4 |
| Example 12 | 8 | 9.7 | yes | 7 | yes | 0 | 5 |

Examples 11 and 12 where the relations A<B and C<A are both satisfied demonstrate good results in terms of amount of agglomerate and image quality. In Example 10 where only the relation A<B is satisfied, the amount of agglomerate precipitated was 3 mg, which is no problem for practical use. On the other hand, Comparative Examples 7 and 8 which fail to satisfy the relation A<B are problematical in amount of agglomerate and image quality.

What is claimed is:

1. A method of pumping an agglomerative liquid comprising: providing a diaphragm pump and pumping agglomerative liquid using the diaphragm pump, the diaphragm pump comprising a diaphragm having a peripheral portion and a movable portion, a pump frame having a diaphragm holding member, and a pump head having a clamping surface which extends along a single plane, the diaphragm being supported on one side of its peripheral portion by the pump frame and clamped on the other side of its peripheral portion by the clamping surface of the pump head, and the diaphragm and the pump head defining a pump chamber, wherein the peripheral portion of the diaphragm has an annular thickened portion in contact with the clamping surface, the thickened portion being thicker than the movable portion and projecting toward the pump head, the clamping surface has an inner peripheral portion, the inner peripheral portion being positioned radially within the thickened portion and spaced from the diaphragm, the pump head has at least one channel, the at least one channel comprising a groove within an inner peripheral wall of the pump head, the groove extending axially from the inner peripheral portion of the clamping surface, the diaphragm is reciprocally movable in opposite directions perpendicular to a diaphragm plane to increase and decrease the volume of the pump chamber so as to pump the liquid, the distance from an innermost periphery of the holding member to an innermost peripheral edge of the thickened portion, measured on the clamping surface of the pump head, is less than the distance between the innermost periphery of the holding member and an innermost peripheral edge of the clamping surface of the pump head, measured on the clamping surface in a region that does not comprise the at least one channel, and the reciprocal movement of the diaphragm is from a flat state toward the pump chamber side and from the flat state toward the side opposite to the pump chamber side.

2. The method according to claim 1, wherein the distance from the innermost peripheral edge of the thickened portion to an outermost peripheral edge of the thickened portion, measured on the surface of the thickened portion clamped by the clamping surface of the pump head, is less than the distance from the innermost periphery of the holding member to the innermost peripheral edge of the thickened portion, measured on the clamping surface of the pump head.

3. The method according to claim 1, wherein the agglomerative liquid is a coating composition containing a polymer latex.

4. The method according to claim 2, wherein the agglomerative liquid is a coating composition containing a polymer latex.

5. The method according to claim 1, wherein at least a surface portion of the diaphragm is made of a fluororesin.

6. The method according to claim 2, wherein at least a surface portion of the diaphragm is made of a fluororesin.

7. The method according to claim 3, wherein at least a surface portion of the diaphragm is made of a fluororesin.

8. The method according to claim 4, wherein at least a surface portion of the diaphragm is made of a fluororesin.

9. A method of producing an inkjet recording medium comprising pumping a coating composition by the method according to claim 3, wherein the coating composition containing a polymer latex is for forming an ink receiving layer of an inkjet recording medium.

10. A method of producing an electrophotographic recording medium comprising pumping a coating composition by the method according to claim 3, wherein the coating composition containing a polymer latex is for forming a toner receiving layer of an electrophotographic recording medium.

11. A method of producing a thermal transfer recording medium comprising pumping a coating composition by the method according to claim 3, wherein the coating composition containing a polymer latex is for forming an image receiving layer of a thermal transfer recording medium.

12. A method of producing a heat developable recording medium comprising pumping a coating composition by the method according to claim 3, wherein the coating composition containing a polymer latex is for forming a photosensitive layer of a heat developable recording medium.

* * * * *